US006012397A

United States Patent [19]

Krahl et al.

[11] Patent Number: 6,012,397

[45] Date of Patent: Jan. 11, 2000

[54] RAILWAY CAR OUTLET GATE ASSEMBLY WITH INERTIAL LATCH

[75] Inventors: Todd A. Krahl, Salina; Anthony L. Lucas, Little River; Allen D. Smith, Salina, all of Kans.

[73] Assignee: Keystone Industries, Inc., Camp Hill, Pa.

[21] Appl. No.: 09/004,491

[22] Filed: Jan. 8, 1998

[51] Int. Cl.[7] ..... B61D 3/00

[52] U.S. Cl. ..... 105/286; 105/305; 105/308.1; 105/247

[58] Field of Search ..... 105/297, 286, 105/305, 308.1, 280, 282.1, 282.2, 282.3, 294, 308.2, 310, 311.1

[56] References Cited

U.S. PATENT DOCUMENTS

| | | | |
|---|---|---|---|
| 3,360,302 | 12/1967 | Bagguley | 105/247 |
| 3,539,224 | 11/1970 | Beezhold | 105/305 |
| 3,635,170 | 1/1972 | Chierici | 105/282 |
| 3,709,152 | 1/1973 | Gutridge | 105/253 |
| 4,094,254 | 6/1978 | Koranda | 105/282 |
| 4,132,177 | 1/1979 | Funk | 105/310 |
| 4,253,400 | 3/1981 | Fischer et al. | 105/282 |
| 4,256,042 | 3/1981 | Fischer | 105/282 |
| 4,284,011 | 8/1981 | Eagle | 105/310 |
| 4,365,837 | 12/1982 | Mizelle | 297/216 |
| 4,450,773 | 5/1984 | Fritz et al. | 105/305 |
| 4,634,182 | 1/1987 | Tanaka | 297/379 |
| 4,664,038 | 5/1987 | Davis | 105/286 |
| 4,664,442 | 5/1987 | Stolper et al. | 297/216 |
| 5,272,987 | 12/1993 | Lucas | 105/308.1 |
| 5,353,713 | 10/1994 | Dohr et al. | 105/310 |
| 5,448,955 | 9/1995 | Dugge et al. | 105/305 |
| 5,507,235 | 4/1996 | Dugge et al. | 105/282.3 |
| 5,584,251 | 12/1996 | Lucas | 105/305 |

*Primary Examiner*—Mark T. Le
*Assistant Examiner*—Robert J. McCarry, Jr.
*Attorney, Agent, or Firm*—Thomas Hooker, P.C.

[57] ABSTRACT

An outlet gate assembly for a hopper type railway car includes a frame adapted to be mounted on an outlet opening in the rail car and a gate in the frame. A conventional rack and pinion opening and closing drive moves the gate between open and closed positions on the frame. An inertial latch mechanism latches the gate in the fully closed position. Actuation of the opening and closing drive displaces the latch to automatically unlatch the gate. Upon impact, an inertial mass generates a latching force holding the latch closed and preventing opening of the gate.

45 Claims, 17 Drawing Sheets

RAILWAY CAR OUTLET GATE ASSEMBLY WITH INERTIAL LATCH

FIELD OF THE INVENTION

The invention relates generally to outlet gate assemblies for railway hopper cars of the type having a latch mechanism which holds the gate closed and unlatches and relatches the gate when the gate is driven between closed and open positions.

BACKGROUND OF THE INVENTION

Hopper-type railroad cars are used to transport lading which is discharged through outlet gate assemblies mounted on discharge openings at the bottoms of the cars. Each outlet gate assembly includes a flat door or gate and a drive for moving the gate between open and closed positions. When closed, the gate prevents discharge of lading. When the gate is opened, the lading is free to discharge through the assembly. Latches are used to prevent opening of the gates by high energy impacts between rail cars.

Conventional gate assemblies use rack and pinion opening and closing drives to shift the gate between open and closed positions. Racks are mounted on the gate. A capstan on one end of an operating shaft is rotated in an appropriate direction to rotate pinion gears on the shaft, shift the racks and move the gate in a desired direction. The rack and pinion drives are mechanically connected to a movable latch by a lost motion latch drive. The latch is positively retracted during initial rotation of a capstan, prior to initial movement of the closed gate in the opening direction. The latch must be withdrawn before the gate moves. During impact the latch can become wedged or hooked in place while holding the gate closed.

Another conventional gate assembly uses a rack and pinion drive including a resilient member positioned between adjacent teeth on a rack. The resilient member engages a tooth of a pinion gear to prevent accidental opening. Rotation of the pinion gear deforms the resilient member to allow the gate to be moved from the closed locked position to the open, unlocked position.

Each of the above conventional gate assemblies is latched by a mechanism forming part of the gate opening and closing drive. These latch mechanisms cannot be used with other types of gate opening and closing drives because the latching mechanism is an integral part of the particular drive. Many of the gate assemblies require a lost motion latch drive to open the latch prior to moving the gate in the opening direction. Such latch drives are difficult and costly to manufacture and install.

Further, wedge-type latches can become jammed against the gate by impact, making unlatching and opening of the gate difficult.

Thus, there is a need for an improved outlet gate assembly having a latch mechanism that automatically latches and unlatches the gate, independently of the gate opening and closing drive. The latch must hold the gate closed on impact, yet permit jam-free opening of the gate by the opening and closing drive.

SUMMARY OF THE INVENTION

The invention is an improved outlet gate assembly with an inertia-type latch mechanism for holding the gate closed against impacts. The latch mechanism is independent of the opening and closing drive. When the gate is closed by the opening and closing drive, a latch is automatically positioned in the opening path of the gate to hold the gate closed. On impact, an inertia force generated by the impact holds the latch in the path of opening movement of the gate to prevent opening of the gate.

Operation of the opening and closing drive to open the gate moves the gate against the latch and freely pushes the latch out of the path of movement of the gate. Upon closing of the gate, the latch is again positioned in the opening path of movement to hold the gate closed against impact. Two embodiments are disclosed.

Each embodiment outlet gate assembly includes a generally rectangular frame defining a discharge opening, a gate movable on the frame between open and closed positions, a conventional opening and closing drive including an operating shaft extending across the front of the gate with capstans on the ends of the shaft and pinion gears on the operating shaft engageable with racks on the bottom of the gate to shift the gate between open and closed positions and an inertia latch mechanism independent of the opening and closing drive.

The latch mechanism includes a latch moveable into and out of the path of opening movement of the gate, an inertial mass and a collapsible two-bar linkage connecting the latch to the frame. The inertial mass is connected to the linkage. On impact, movement of the frame relative to the mass generates an inertial force which is applied to the linkage to prevent collapse of the linkage and hold the gate closed. The inertial force is considerably less than the opposing impact-generated opening force exerted on the latch by the relatively heavy gate. The two-bar linkage has an inertia force multiplying geometry assuring that the inertia force prevents collapse of the linkage on impact, despite the large opening force. When the gate is closed the latch mechanism holds the latch in the closed position to prevent opening of the gate by vibration, train action and other low energy loadings.

The opening and closing drive is used to open and close the gate. Actuation of the drive to open the gate pushes the gate against the latch to move the latch out of the path of movement of the gate as the gate is shifted to the open position. Movement of the latch collapses the linkage and moves the inertial mass.

Actuation of the opening and closing drive to close the gate returns the gate to the closed position. When the gate is closed, the latch mechanism returns the latch to the latch position in the path of opening movement of the gate and holds the latch in this position.

The latch mechanism is completely independent of the opening and closing drive, operates during impacts to prevent opening of the gate and permits opening of the gate by the opening and closing drive. Opening and closing drives other than rack and pinion drives may be used.

In a first embodiment of the invention, the latch mechanism includes a two-bar linkage where first and second bars are pivotally connected and arranged at an interior angle of slightly less than 180 degrees and where the latch is provided on one bar. The other bar is pivotally connected to the frame. An opening force applied to the latch by the gate on impact tends to collapse the linkage and decrease the interior angle between the bars. An inertia force generated by a pendulum inertial mass on impact is applied to the pivot connection between the two bars in a direction to resist collapse. The geometry of the latch mechanism assures that during impact the inertial force prevents collapse of the latch mechanism and holds the gate closed.

In a second embodiment of the invention, the latch mechanism includes a two-bar linkage where the bars are pivotally connected and arranged at an interior angle of slightly less than 90 degrees. One end of a bar with a latch is pivotally connected to the frame and an end of the other bar slidingly engages the frame. During impact, a sliding inertial mass generates an inertial force which is applied to the other bar in a direction to prevent collapse of the latch mechanism and decrease of the interior angle to hold the gate closed.

Both latch mechanisms include one way connections between the inertial mass and the two-bar linkages so that impacts on the assemblies which tend to move the gate toward the closed position, away from the open position, do not displace the latch. Each latch mechanism includes a stop which prevents collapse of the linkage to increase the interior angle.

Gate assemblies using the present inertial latch mechanism reliably hold the plates closed during high energy impacts yet are easily opened by rotation of a conventional opening and closing drive which is independent of the latch mechanism. The independence of the opening and closing drive from the latch mechanism means that the manufacturer of gate assemblies can provide an inertia-type latching mechanism as disclosed on otherwise conventional outlet gate assemblies using well tested and accepted conventional rack and pinion opening and closing drives. There is no need to integrate the latch mechanism into the opening and closing drive or provide a lost motion connection between the latch and a capstan on an end of the operating shaft.

Gate assemblies are opened either by rotating capstans manually or using a power tool. When a gate assembly is opened manually, the capstan is rotated using a long lever bar which engages the capstan and permits rotation through a limited arc before the bar must be removed and re-engaged in a different position on the capstan. The present gate assembly provides an automatically engageable and disengageable latch where lost motion rotation of the capstan is eliminated. Elimination of the lost motion rotation of the capstan facilitates manual opening and closing of the assemblies by reducing the angle through which the capstan must be rotated.

The independence of the opening and closing drive and the latch mechanism facilitates maintenance and repair of the drive and mechanism. Each element may be serviced and repaired independently of the other. Inspection to assure proper operation is also facilitated by the independence of the drive and mechanism. Further, from a manufacturing perspective, the inertia latch mechanism may be used with a number of different types of gate assemblies each having a conventional rack and pinion opening and closing drive, thereby reducing cost.

Other objects and features of the invention will become apparent as the description proceeds, especially when taken in conjunction with the accompanying drawings illustrating the invention, of which there are seventeen sheets.

DESCRIPTION OF THE PREFERRED EMBODIMENT

Figure 1:
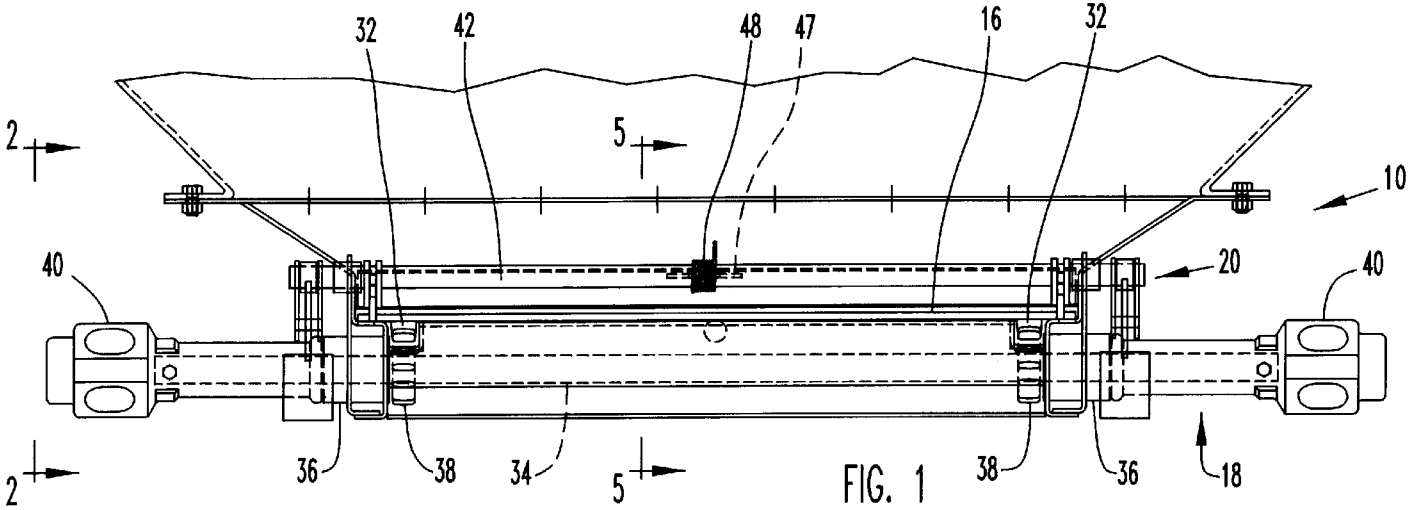
FIG. 1 is a front view of a first embodiment of an outlet gate assembly with an inertial latch mechanism.

FIGS. 1 through 11 illustrate the first embodiment outlet gate assembly.

In the first embodiment outlet gate assembly 10 includes a rectangular frame 12 defining a discharge opening 14. A rectangular door or gate 16 is mounted in frame 12 and is movable between a closed position in which the gate 16 completely closes opening 14 and an open position in which the gate 16 is to one side of opening 14. The gate 16 is moved between the open and closed positions by a gate opening and closing drive 18. An inertial latch mechanism 20 latches the gate 16 in the closed position.

The frame 12 of the outlet gate assembly 10 is bolted to a discharge opening in the bottom of a hopper-type railway car (not shown) to control the discharge of lading from the car. The outlet gate assembly may also be bolted to a transportable hopper, for example, an over-the-road hopper-type trailer pulled by a tractor truck.

Figure 2:
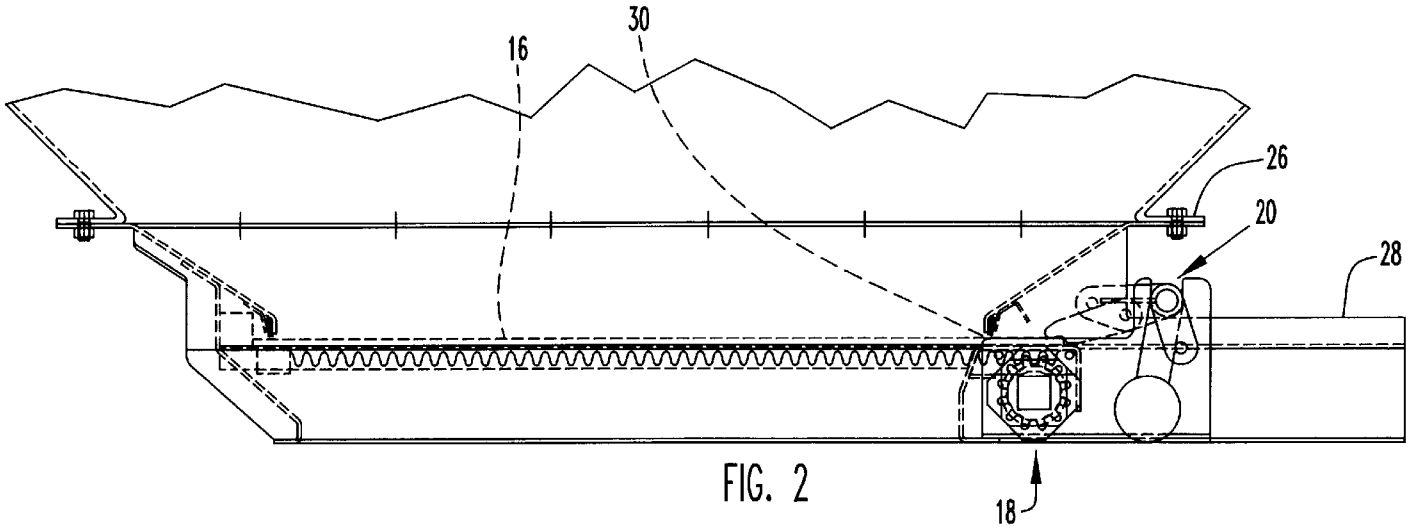
FIG. 2 is a side view of the assembly of FIG. 1 taken along line 2—2 of FIG. 1.
Figure 3:
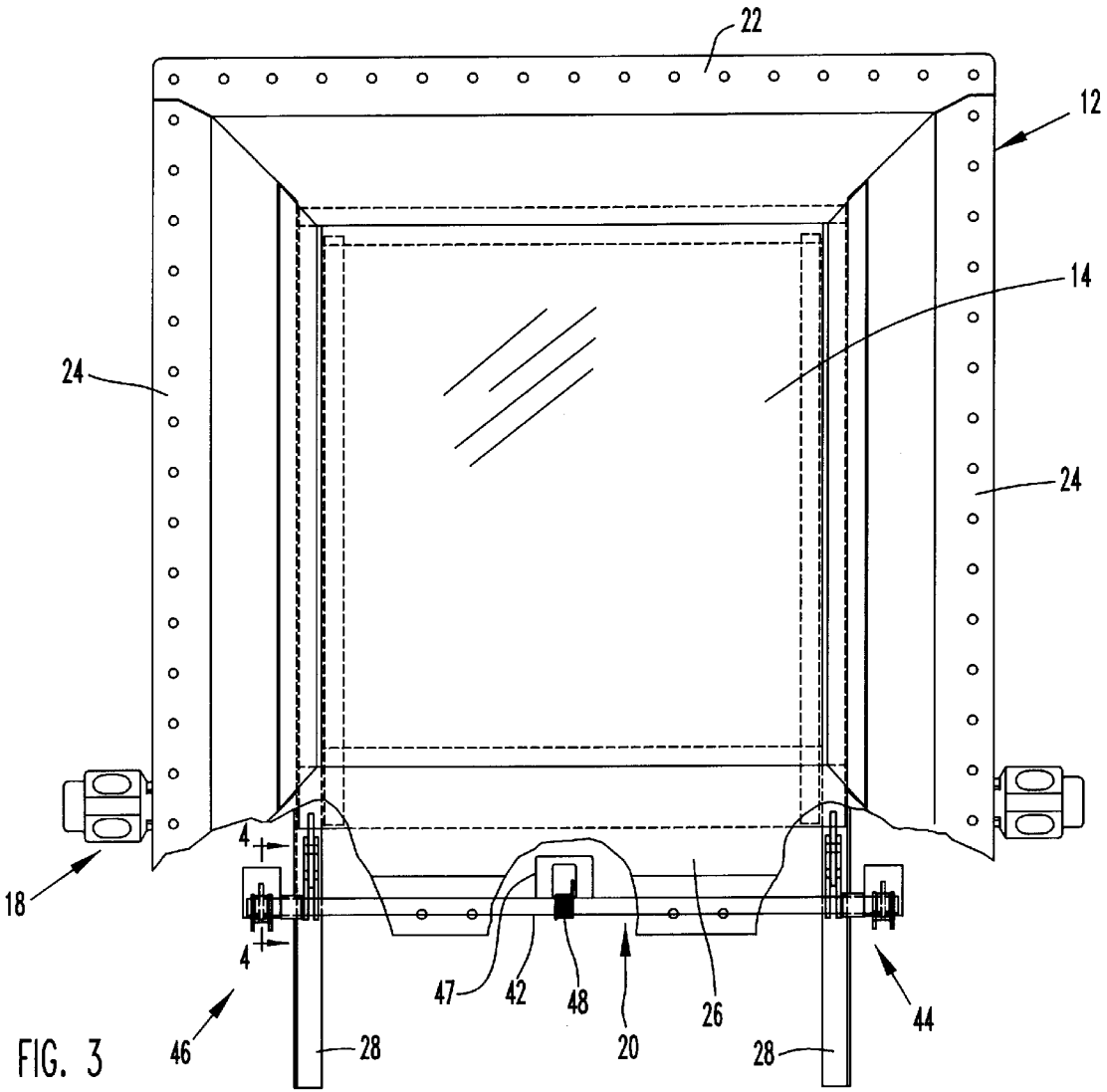
FIG. 3 is a top view of the assembly of FIG. 1.
Figure 4:
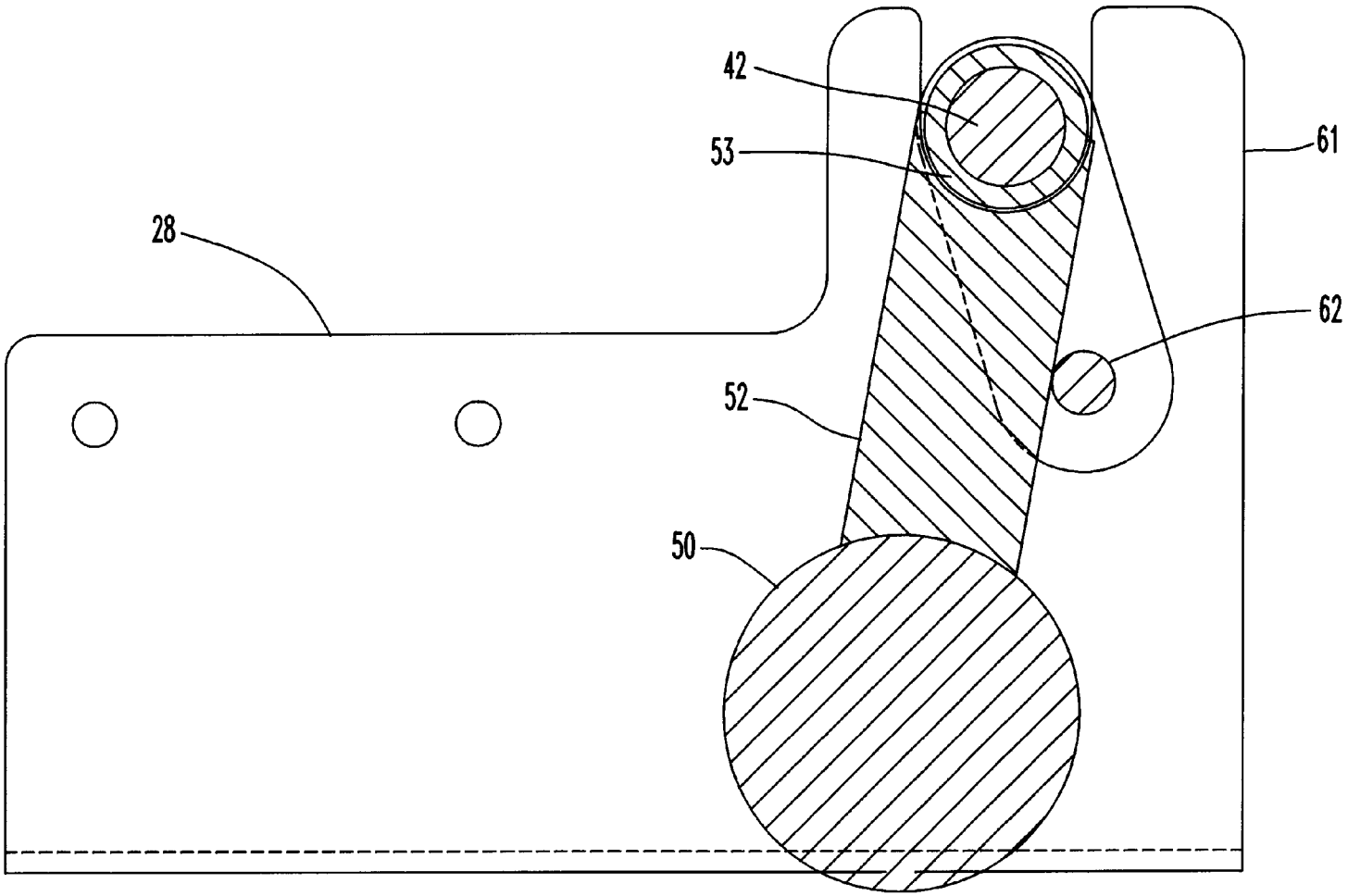
FIG. 4 is a partial side view of the assembly of FIG. 3 taken along line 4—4 of FIG. 3.

The frame 12 includes a rear frame member 22, a pair of side frame members 24, and a front frame member 26 to define the discharge opening 14. Extensions 28 of side frame members 24 project beyond the front frame member 26. The gate 16 extends through a slot 30 formed in the front frame member 26 as shown in FIG. 2.

The gate 16 is moved from the closed position out through slot 30 to the open position by gate opening and closing drive 18 mounted on side frame member extensions 28. The drive 18 is conventional and includes a pair of spaced apart parallel racks 32 mounted on the lower surface of gate 16, a square operating shaft 34 extending between and through side frame extensions 28 and journalled in bearings 36 mounted on the extensions 28 and a pair of pinion gears 38 meshed with the teeth of racks 32. The pinion gears 38 are fixedly mounted on the operating shaft 34 and rotate with the operating shaft 34. The ends of the operating shaft 34 extend outwardly or outboard of the frame side extensions 28. A pair of capstans 40 are fixedly mounted on the ends of the operating shaft 34 and rotate with the operating shaft 34.

Inertial latch mechanism 20 includes a support shaft 42, a pair of like inertia latches 44 and 46 mounted on opposite ends of the support shaft 42, and a spring 48 wound around the support shaft 42 between the inertial latches 44 and 46. The support shaft 42 extends across the width of frame 12 above the opening and closing path of the gate 16 and through holes formed in side frame extensions 28 and outwardly of the extensions. A U-shaped spring support plate 47 is attached to the support shaft 42. One end of the spring 48 engages the front frame member 26 and the other end of the spring 48 engages the spring support plate 47.

Because each of the inertia latches 44 and 46 are similar in construction, only the construction of inertia latch 44 will be described below, it being understood that both inertia latches include the same elements.

The inertia latch 44 includes a two-bar linkage 49, an inertial mass 50 and an arm 52. The two-bar linkage 49 includes a pair of like, spaced apart thrust links 54 forming a first bar or link 55 and a second bar or link 56. The thrust links 54 are nonrotatably attached to the support shaft 42 inwardly of side frame extension 28. One end of the bar 56 is pivotally mounted between links 54 by pivot pin 58. The opposite end of the bar 56 extends toward front frame member 26 and includes latch 57. Stop pin 60 extends between the two thrust links 54 outwardly of pin 58 to limit relative rotation of the bar 56 about pin 58.

Figure 11:
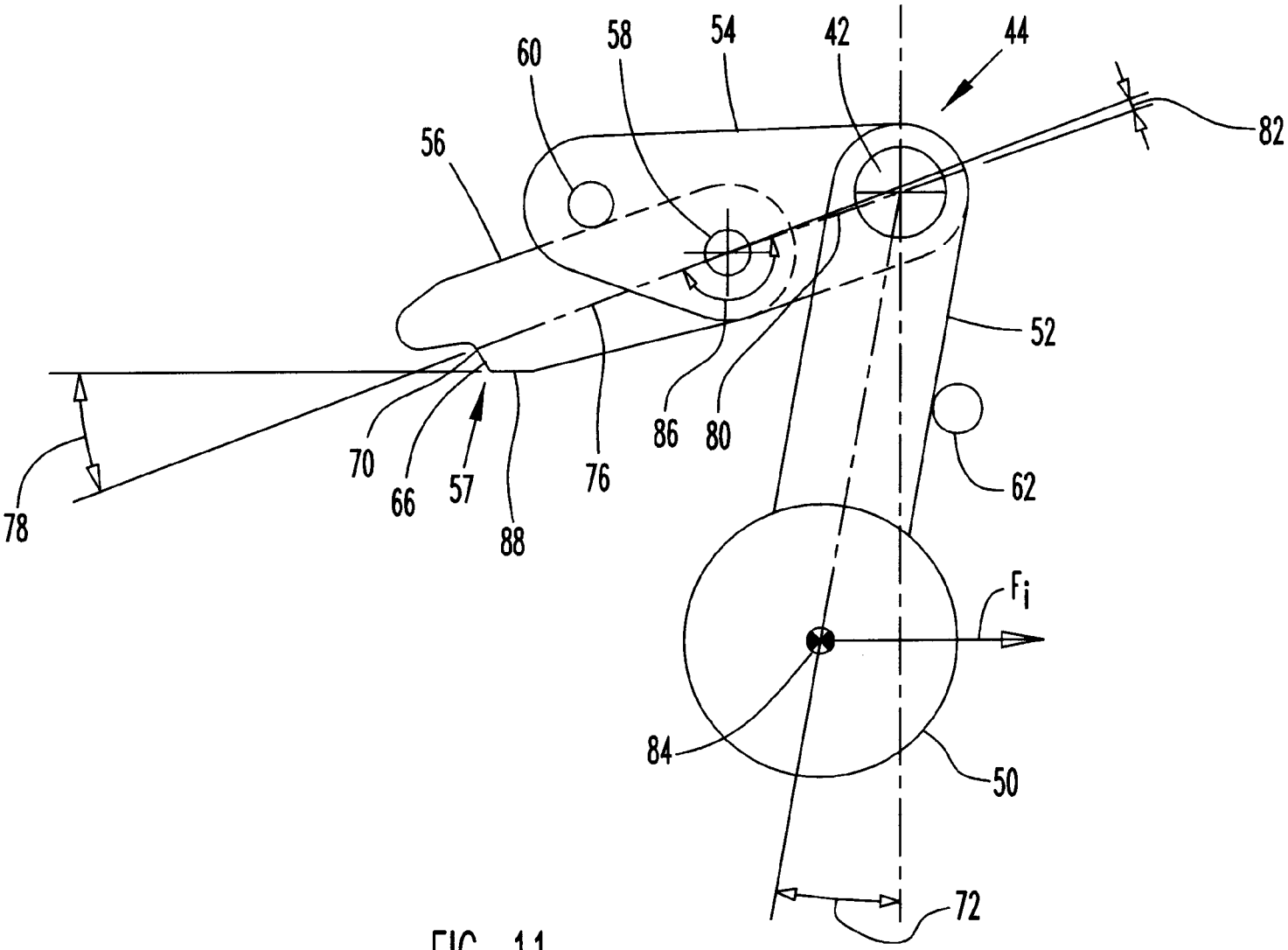
FIG. 11 is a diagrammatic view of an inertial latch mechanism of the outlet gate assembly shown in FIG. 1 in the latched position.

Pendulum inertial mass 50 is mounted on the lower end of arm 52. The upper end of arm 52 is rotatably mounted on the support shaft 42 by collar 53. The arm 52 and inertial mass 50 are located outwardly of side frame extension 28. A stop pin 62 is mounted on an extension 61 non-rotatably attached to support shaft 42. The stop pin 62 is adjacent the arm 52 and normally holds the arms and mass slightly clockwise from vertical, as shown in FIGS. 5 and 11.

Bar 56 includes nose 64 with a cam surface 66 at latch 57. The cam surface 66 is configured to engage the front edge of the closed gate 16 at a latch contact point 70 to prevent opening movement of the gate 16 relative to the frame 12 and to permit positive displacement of the second bar 56 by the gate when the gate 16 is moved from the closed position towards the open position by drive 18, as will be described in greater detail below.

Figure 5:
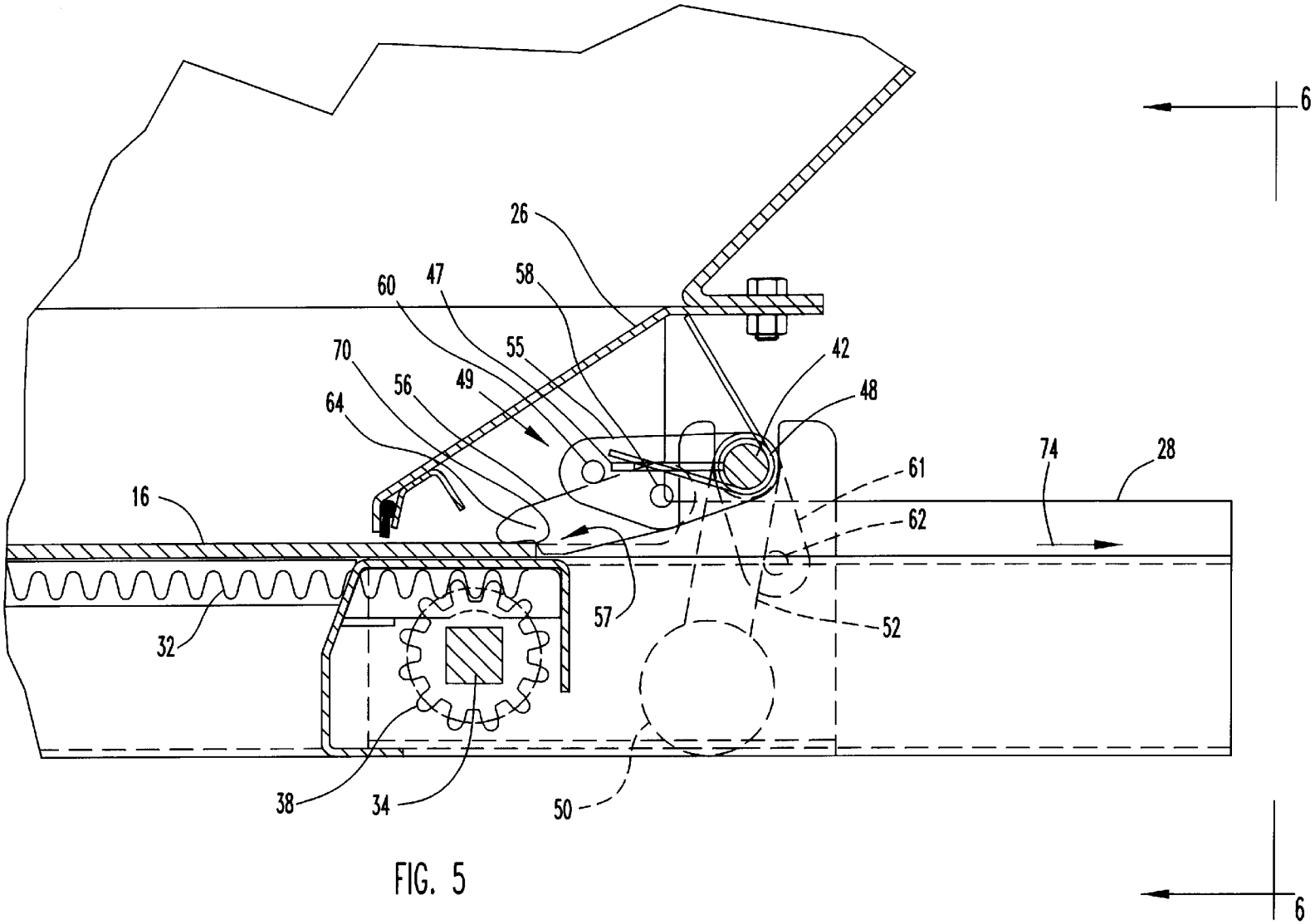
FIG. 5 is a sectional view taken along line 5—5 of FIG. 1 illustrating the outlet gate assembly in the closed position.
Figure 6:
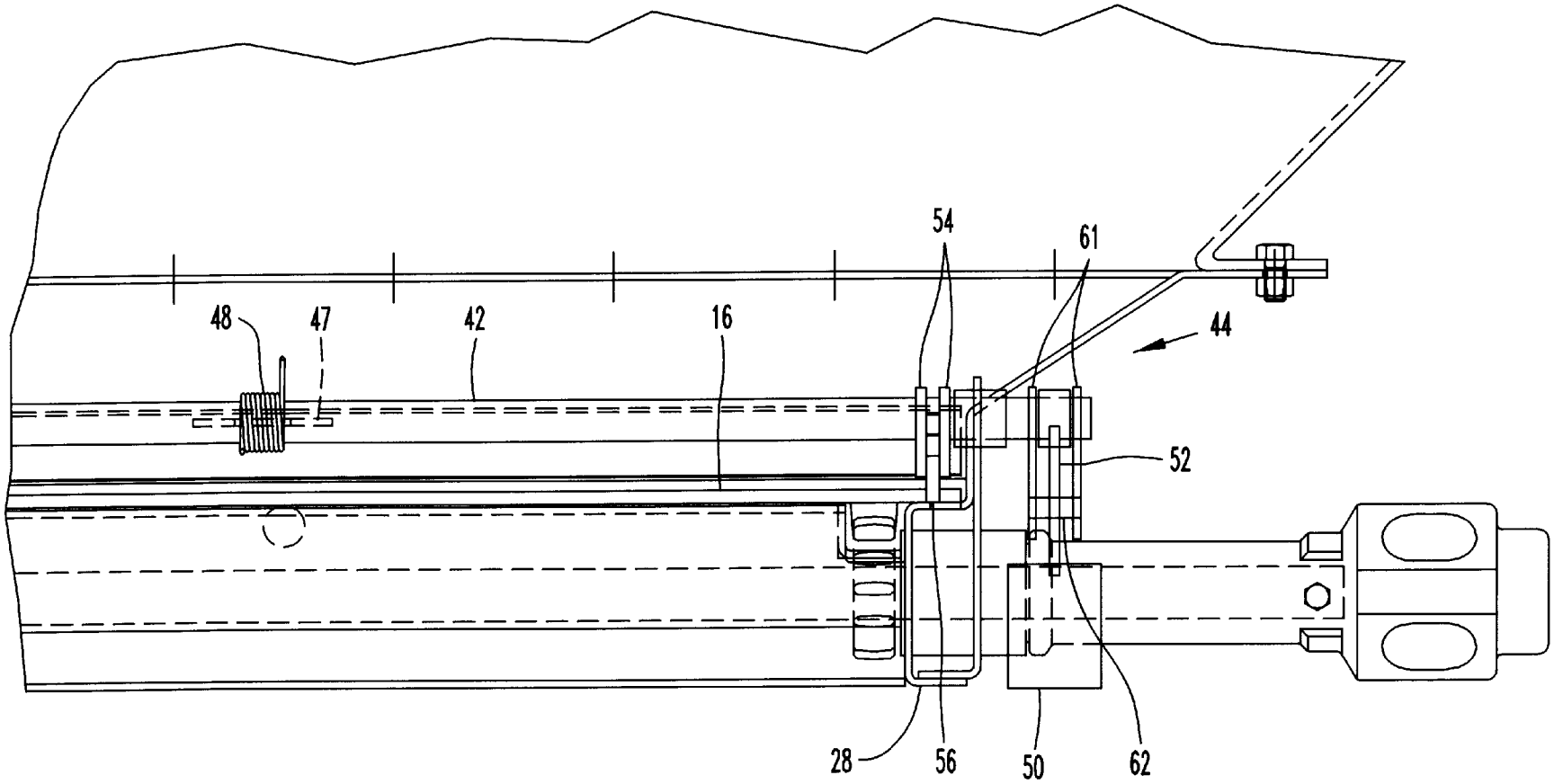
FIG. 6 is a partial front view of FIG. 5.
Figure 7:
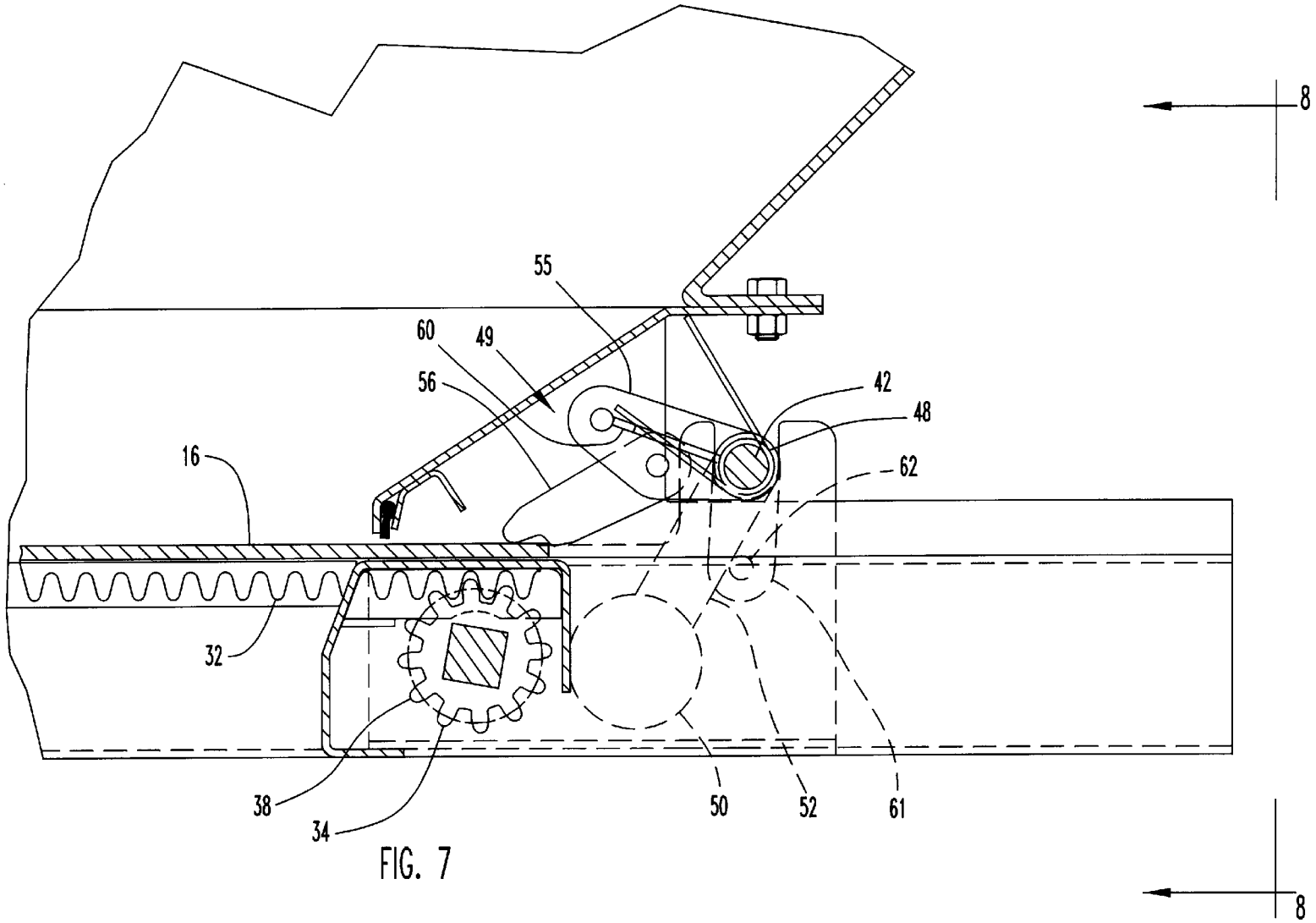
FIG. 7 is a sectional view taken generally along line 5—5 of FIG. 1 illustrating initial opening of the outlet gate assembly.
Figure 8:
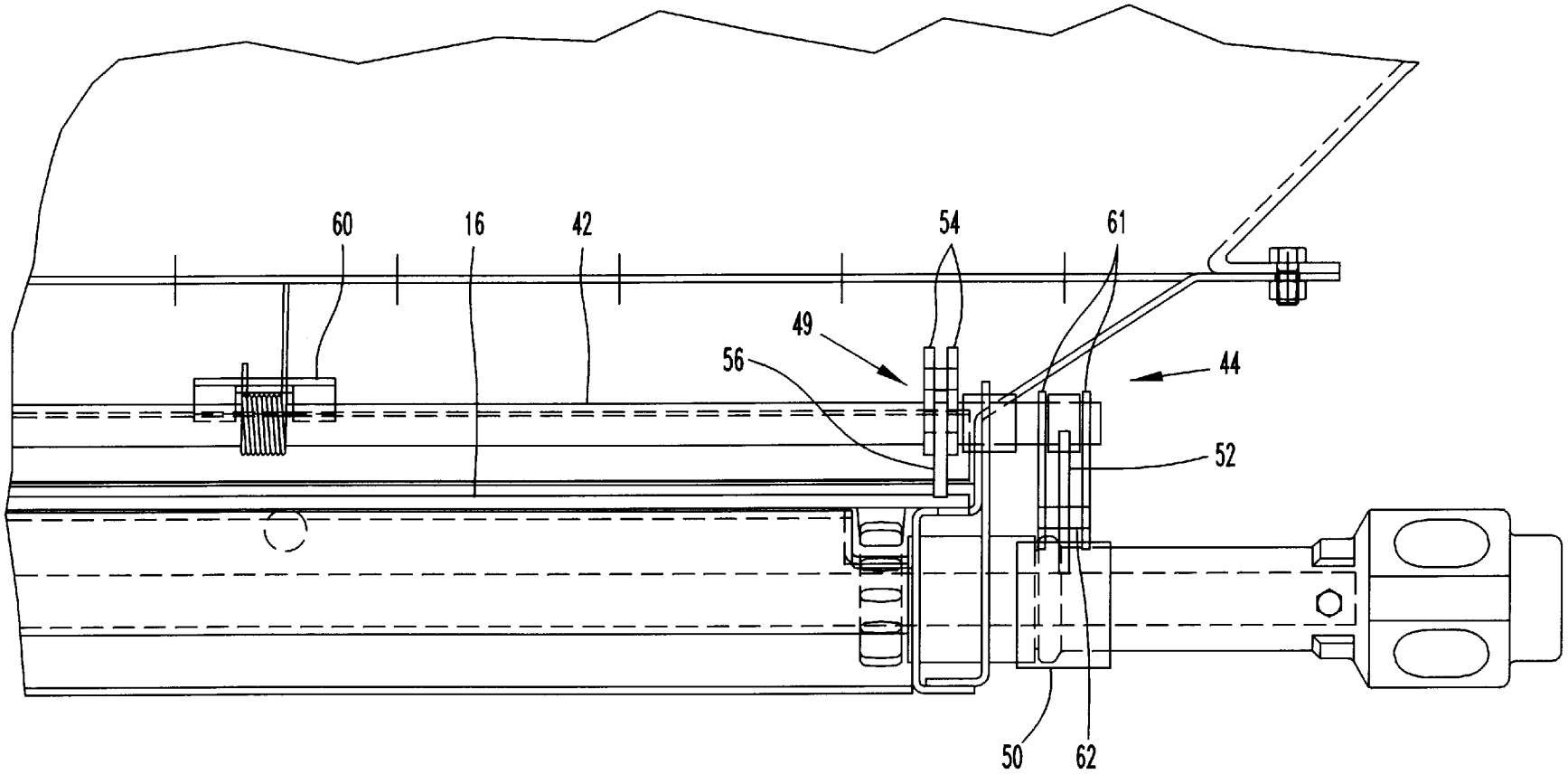
FIG. 8 is a partial front view of FIG. 7.

The spring 48 biases the support shaft 42 and the first bar 55 in a counterclockwise direction as shown in FIG. 5. The inertial mass 50 is offset from the vertical by an offset angle 72 (see FIG. 11) so that the weight of the inertial mass 50 presses the arm 52 against stop pin 62 to also bias the support shaft 42 and the bar 55 in a counterclockwise direction as shown in FIG. 5.

The operation of the outlet gate assembly 10 in opening and closing the outlet gate assembly 10 will now be described.

When gate 16 is fully closed as in FIG. 5, the spring 48 and the offset inertial mass 50 generate a moment or torque which urges the support shaft 42 and the first bar 55 in a counterclockwise direction to hold nose 64 of second bar 56 against the top surface of the gate 16. In this position, pin 60 engages the top of the second bar and holds latch 57 down against the adjacent front edge of gate 16, in the path of travel of the gate 16 toward the open position.

The second bar 56 presses against the gate 16 because of the biasing force generated by both the spring 48 and the offset positioning of inertial mass 50. The latch cam surface 66 obstructs the gate 16 to prevent the gate 16 from moving from the closed position toward the open position. The biasing force applied to the second bar 56 by the spring 48 and inertial mass 50 is sufficient to maintain the second bar 56 and latch in the position shown in FIG. 5 to prevent opening of the gate 16 due to vibrations of the railroad car during transit, train action loadings and other low energy loadings experienced by the railcar.

The outlet gate assembly 10 may be opened by a worker from either side of the rail car by rotating one of the capstans 40 in an opening direction. The worker may rotate the capstan 40 by using a power drive engaging the capstan 40 or a pry bar having an end inserted into the capstan 40.

Opening rotation of a capstan 40 rotates the operating shaft 34 and the pinion gears 38 meshed with racks 32 to begin moving the gate 16 in the opening direction of arrow 74 shown in FIG. 5. The gate 16 pushes on the second bar 56 at the latch contact point 70 of cam surface 66 and applies a horizontal opening force against the second bar 56. As gate 16 is moved from the closed position to the open position the second bar 56 is pushed from its latched position shown in FIG. 5 up and out of the opening path of the gate 16 to positively displace the second bar 56 to an unlatched position shown in FIG. 9, thereby automatically unlatching the outlet gate assembly 10 in response to opening of the gate by drive 18.

Starting with the outlet gate assembly 10 in the closed and latched position shown in FIG. 5 with stop pin 60 engaging bar 56, the latch contact point 70 and the center of pivot pin 58 define an axis 76 of the second bar 56 oriented at an angle 78 with respect to the horizontal (See FIG. 11). The centers of pivot pin 58 and support shaft 42 define an axis 80 of the first bar offset at a small 2 degree angle 82 with respect to the axis 76. Axes 76 and 80 intersect at the center of pin 58 and define a downwardly facing interior angle 86 of 178 degrees, slightly less than 180 degrees.

The horizontal opening force generated during opening by gate 16 pushing on the second bar 56 at angled latch point 70 pushes the second bar 56 up out of the opening path of the gate 16.

A component of the opening force is transmitted by the second bar 56 to the pivot pin 58. The pivot pin 58 in turn transmits the force to the first bar 55. However, because the first bar 55 and the second bar 56 form the interior angle 86 of less than 180 degrees, the latch opening force collapses the two linked bars and moves pin 58 up to decrease the interior angle. The first bar is pushed up and clear of the lead edge of the gate so that heel 88 rests on the top of the gate during opening. Possible wear at the heel does not change the geometry of the latch. The gate opening and closing drive 18 generates sufficient opening force to overcome the biasing force of spring 48 and mass 50. The inertial latch mechanism 20 remains in the position shown in FIG. 9 as the gate 16 is moved to the fully open position.

The fully open outlet gate assembly 10 is moved to the fully closed and latched by rotating either of the capstans 40 in a closing direction. Closing rotation of the capstans 40 will rotate the operating shaft 34 and the pinions gears 38 to move gate 16 inwardly. As the gate 16 is moved to the fully closed position, the top surface of gate 16 moves along heel 88, well clear the cam surface 66 of second bar 56 and the second bar 56 drops into the latched position in the path of opening travel of the gate 16 when the gate is closed to latch the gate 16 closed.

High energy impacts which sharply move the railcar in a direction opposite to the opening direction of gate 16 expose the outlet gate assembly 10 to inertial accelerations which tend to move the closed gate 16 in the opening direction. An example of such an impact is the impact of the railway car with a stationary line of railway cars for coupling. If the railway car with the outlet gate assembly 10 shown in FIG. 2 was impacted or accelerated to the left, an inertial force would be exerted on gate 16 in the opening direction and, absent the inertial latch mechanism 20, gate 16 could undesirably open.

The operation of the outlet gate assembly 10 to hold the gate closed during an impact will now be described.

The outlet gate assembly 10 is closed position as shown in FIG. 5 when an impact occurs tending to move the gate 16 in the opening direction. The impact acceleration causes the gate 16 to apply an opening force to the latch 57 tending to move the second bar 56 from the latched position to the unlatched position.

The inertial mass 50 senses the impact acting on the railway car. The impact acceleration accelerates the inertial mass 50 in the opening direction, that is, to the right as shown in FIG. 2. The inertia of mass 50 generates an inertial force Fi, shown in FIG. 11, in response to the impact. This force biases mass 50 and arm 52 in a counterclockwise direction against pin 62 to bias shaft 42 and first bar 55 mounted thereon in a counterclockwise direction so that stop pin 60 is held down against the top of the second bar 56 and presses the second bar down firmly to hold the latch 57 against the adjacent front edge of gate 16. Simultaneously, the impact acceleration of the gate 16 causes the heavy gate 16 to push against the latch with an opening force. In the absence of the inertial force Fi, the opening force pushing against the latch 57 would collapse the two-bar linkage and decrease the interior angle by moving pin 58 up and rotating the support shaft 42 in the opening or clockwise direction and move the latch out of the opening path of the plate, freeing the plate to move open. The downward force executed on bar 56 by pin 60 holds the linkage 49 against upward collapse during impact. Because the interior angle 86 is less than 180 degrees the linkage can collapse upward only. The inertia force Fi holds the linkage 49 against collapse with the latch 57 abutting the gate to prevent impact movement on the gate 16 in the opening direction.

Once the impact dissipates the latch mechanism 20 the latch 57 is held in the closed position against the gate by the biasing force generated by the spring 48 and the inertial mass 50, as described above.

Gate 16 is relatively massive. Multi G impacts subject the two latch mechanisms to high opening forces tending to collapse the mechanisms upwardly and decrease the interior angle, as previously described, because the interior angles 86 are slightly less than 180 degrees. For each impact, the opening force tending to collapse the linkages 49 upwardly is resisted by the forces Fi. The downward forces exerted on the pins by forces Fi are considerably smaller than the force exerted on the second bars 56 by the plate. The geometries of the two-bar linkages, with the less than 180 degree interior angles 86 assure that the downward forces exerted on pins 58 by inertial forces Fi hold the latches in place despite the high opening force exerted on each latch by the relatively heavy plate. Most of the force exerted on the latch assemblies by the plate is transferred to support shaft 42 and to the frame 12. In each latch, a small vertical component of the force, proportional to the product of opening force and the sine of angle 82, biases pin 58 upwardly. The downward force exerted on the pin 58 by force Fi is greater than this force, assuring that the latch mechanisms are held closed so that the impact does not open the gate. The two-bar linkage has a force-multiplying geometry that allows the force Fi to be less than the opening force generated by the gate, yet assures that the force Fi overcomes the opening force and holds the gate closed.

If the outlet gate assembly 10 is subjected to an impact tending to move the gate 16 in the closing direction (to the left as shown in FIG. 5) when the gate 16 is in the closed position, the rear frame member 22 will prevent movement of the gate 16. The impact will accelerate the inertial mass 50 to the left with respect to the frame 12 and, will cause the inertial mass 50 to rotate freely in a clockwise direction about the support shaft 42 without transmitting torque to the support shaft 42. The latch mechanisms 20 are not opened by the impact. Clockwise rotation of the inertial mass 50 about the support shaft 42 is limited by the capstans 40, although a limit member rigidly attached to the frame 12 can alternatively be provided. Spring 48 holds the latches closed.

Stop pin 60 normally engages the top of the second bar 56 to hold the bar down against the top of gate 16 in the latched position. The pin is held against the second bar by spring 48 and the off vertical mass 50, as previously described. The stop pin 60 also maintains the two bars in relationship to each other with interior angle 86 slightly less than 180 degrees. The pin further prevents possible downward collapse of the two-bar linkage by an impact.

On impact, each rotary inertial mass 50 is free to move or rotate relative to frame 12 in the opening direction of gate 16. Impacts tending to open the gate accelerate the masses and assure the gate is latched closed.

FIGS. 12 through 19 illustrate a second embodiment gate assembly 110. As in the outlet gate assembly 10, outlet gate assembly 110 includes a rectangular frame 112 defining a discharge opening 114. A generally rectangular door or gate 116 is mounted in frame 112 and is movable between a closed position in which the gate 116 completely closes opening 114 and an open position in which the gate 116 is free of the opening 114. The gate 116 is moved between the open and closed positions by a gate opening and closing drive 118. A single central inertial latch mechanism 120 latches the gate 116 in the closed position.

Figure 12:
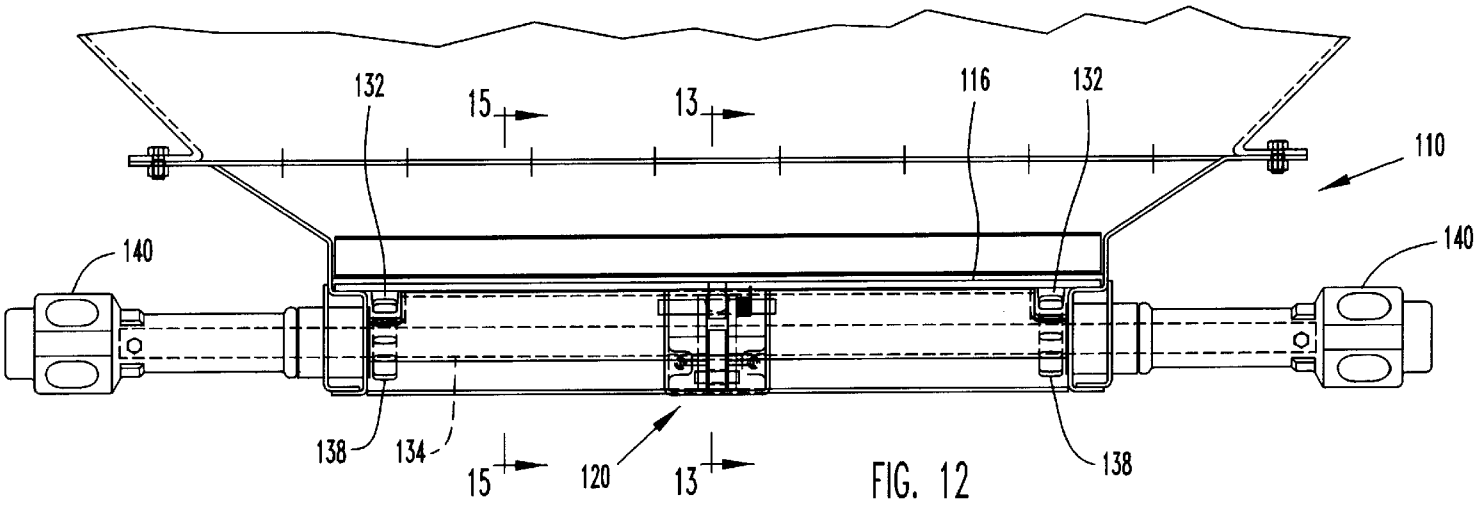
FIG. 12 is a front view of a second embodiment of an outlet gate assembly with an inertial latch.
Figure 13:
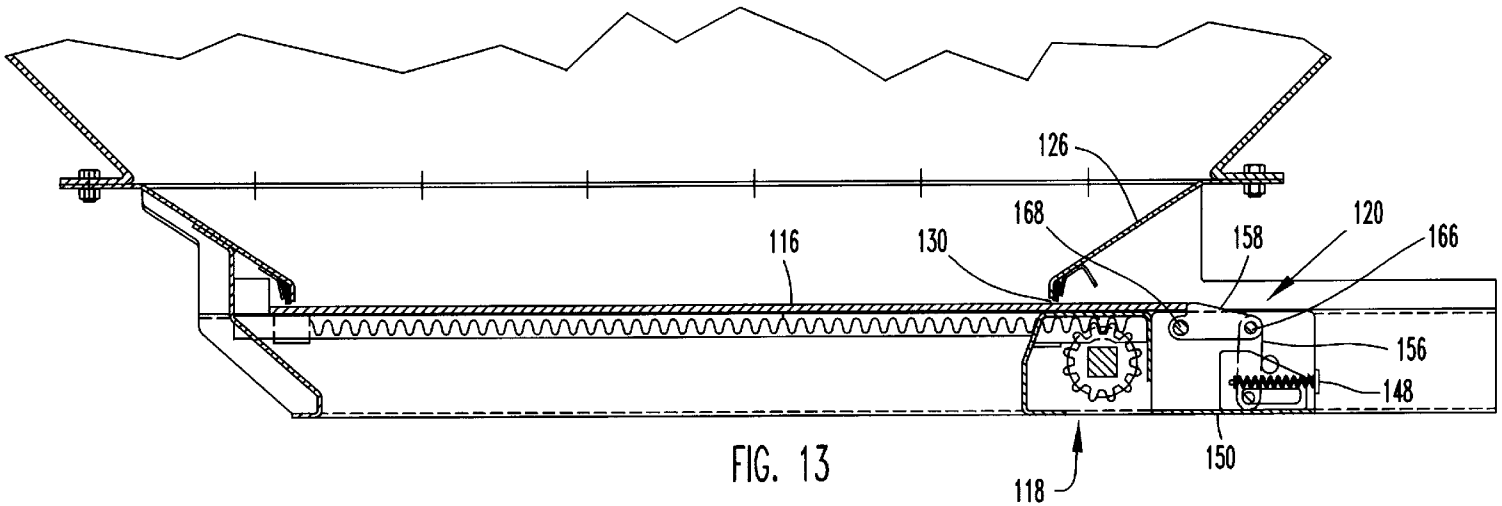
FIG. 13 is a side view of the assembly of FIG. 12 taken along line 13—13 of FIG. 12.
Figure 14:
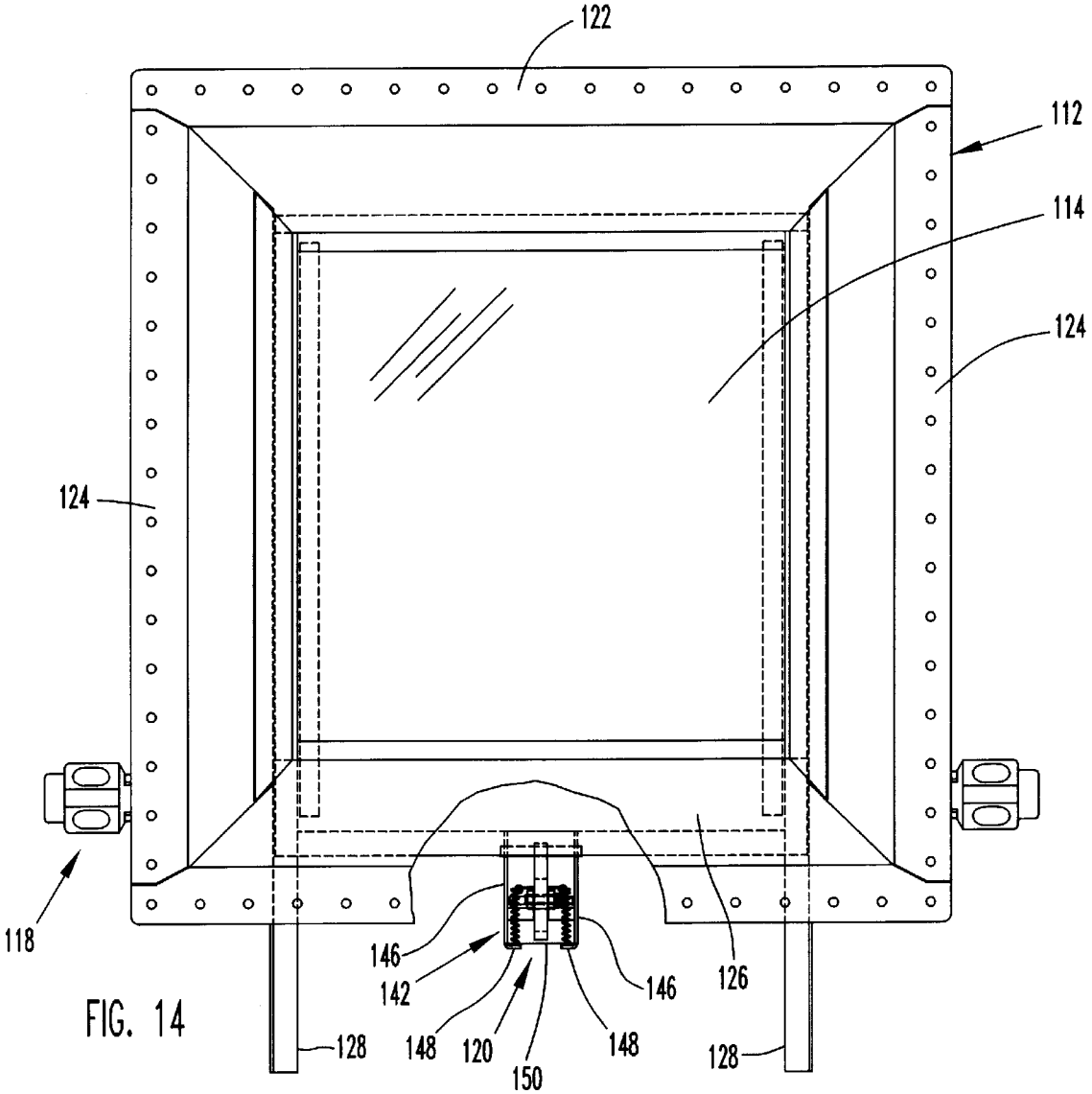
FIG. 14 is a top view of the assembly of FIG. 12.

The frame 112 includes a rear frame member 122, a pair of side frame members 124, and a front frame member 126 to define the discharge opening 114. Extensions 128 of side frame members 124 project beyond the front frame member 126. The gate 116 extends through a slot 130 formed in the front frame member 126 as shown in FIG. 12.

The gate 116 is moved from the closed position out through slot 130 to the open position by the gate opening and closing drive 118 mounted on side frame member extensions 128. The drive 118 is identical to drive 18 of assembly 10 and includes a pair of spaced apart parallel racks 132 mounted on the lower surface of gate 116, a square operating shaft 134 extending between and through side frame extensions 128 and journalled in bearings 136 mounted on the extensions 128 and a pair of pinion gears 138 meshed with the teeth of racks 132. The pinion gears 138 are directly or fixedly connected to the operating shaft 134 and rotate with the operating shaft 134. The ends of the operating shaft 134 extend outwardly or outboard of the frame side extensions 128. A pair of capstans 140 are directly mounted on the ends of the operating shaft 134 and rotate with the operating shaft 134.

The inertial latch mechanism 120 includes a subframe 142 mounted on the center of front frame member 126 below the opening and closing path of travel of the gate 116 and including a pair of spaced apart side walls 146, a front wall 148 and a floor or base 150.

Figure 15:
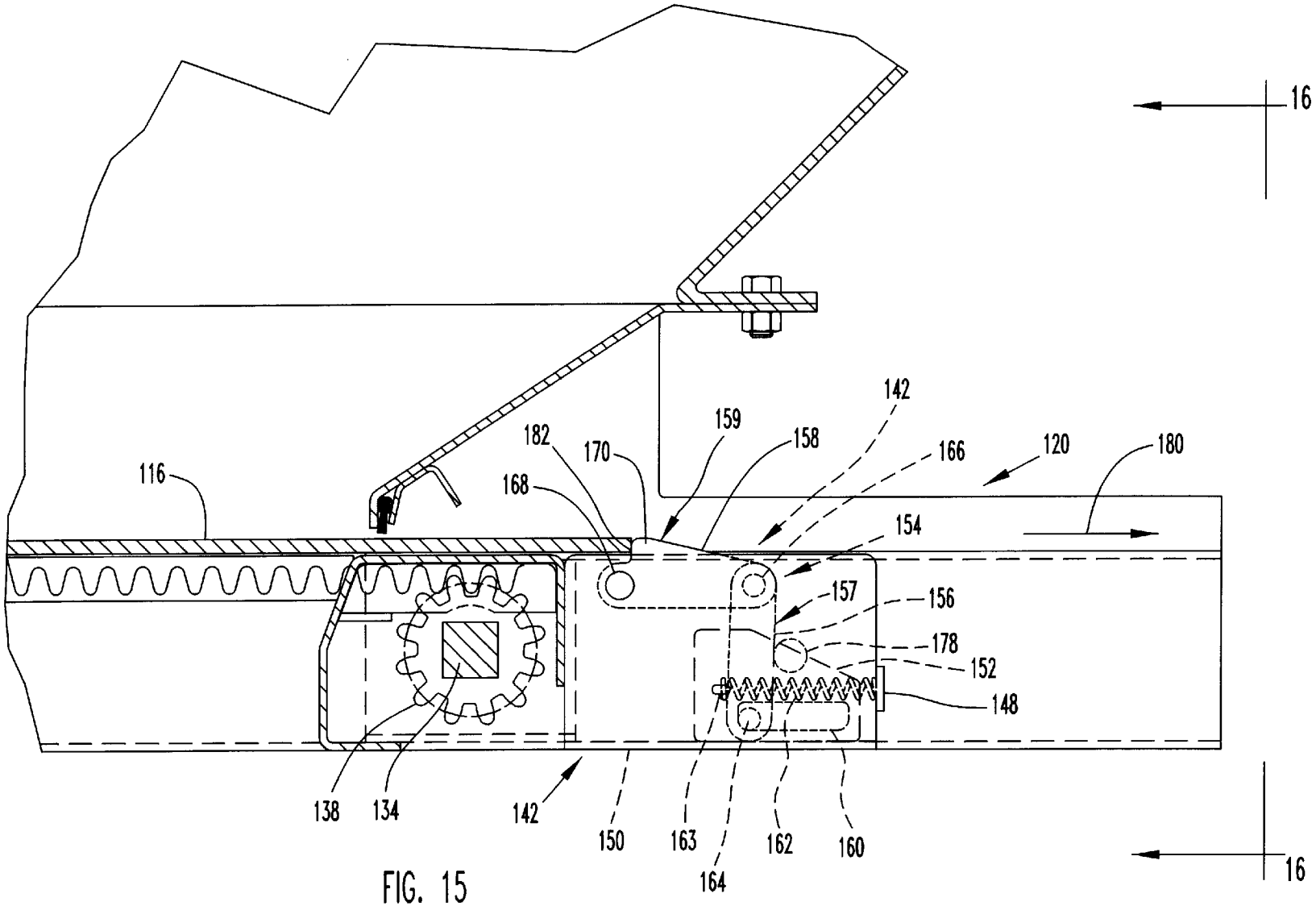
FIG. 15 is a sectional view taken along line 15—15 of FIG. 12 illustrating the outlet gate assembly in the closed position.
Figure 16:
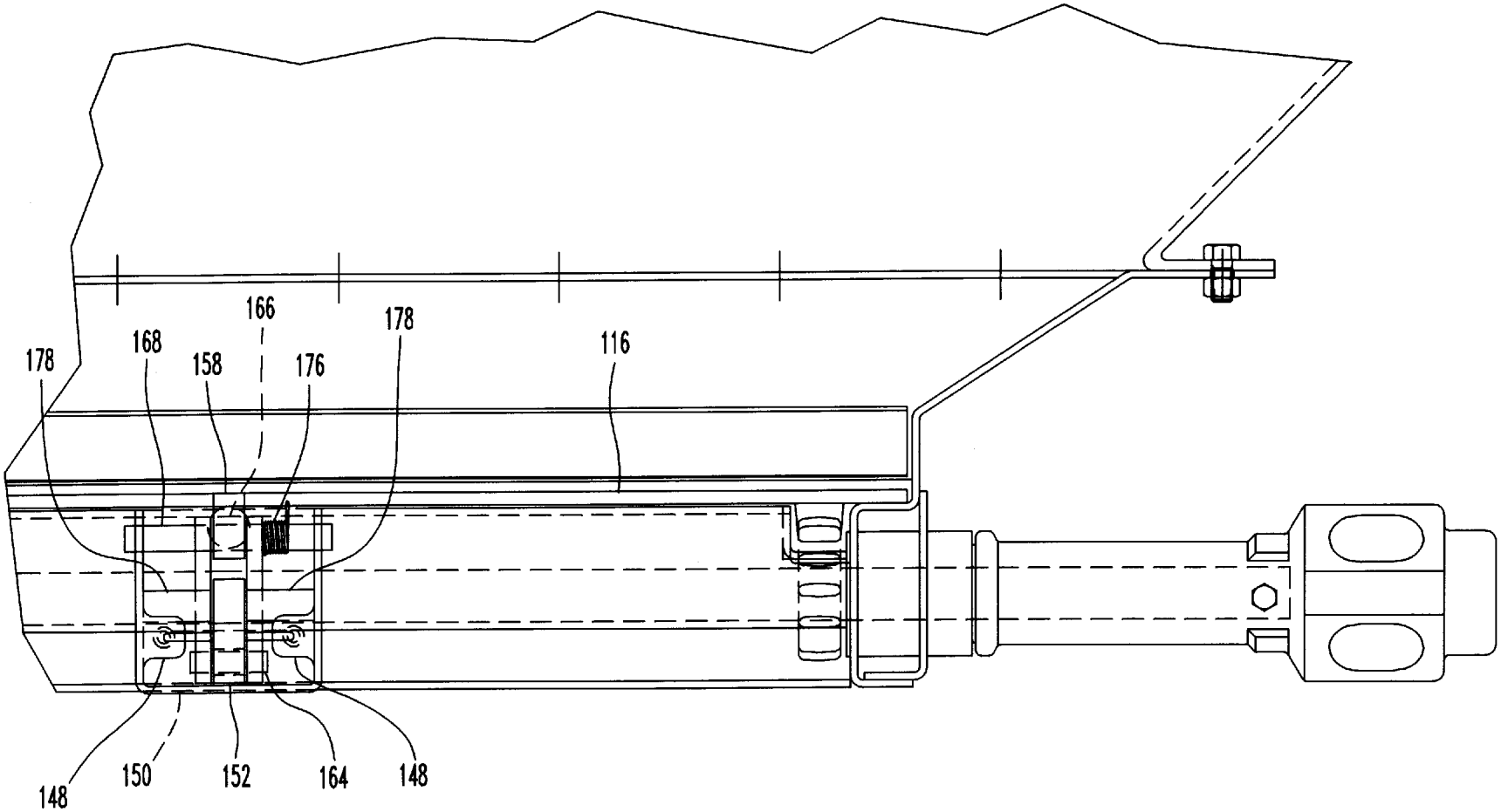
FIG. 16 is a partial front view of FIG. 15.
Figure 17:
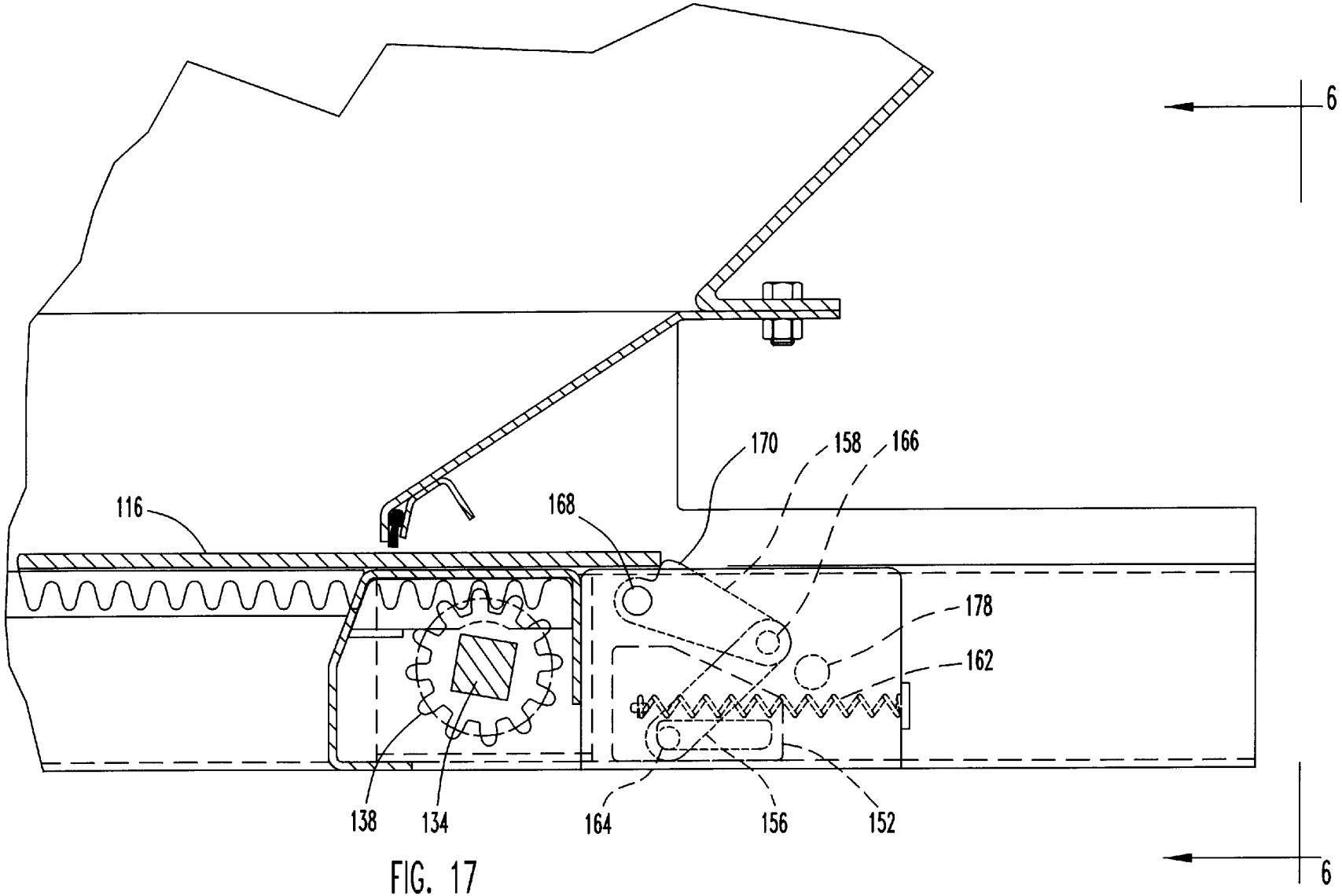
FIG. 17 is a sectional view similar to FIG. 15 but illustrating initial opening of the outlet gate assembly.
Figure 18:
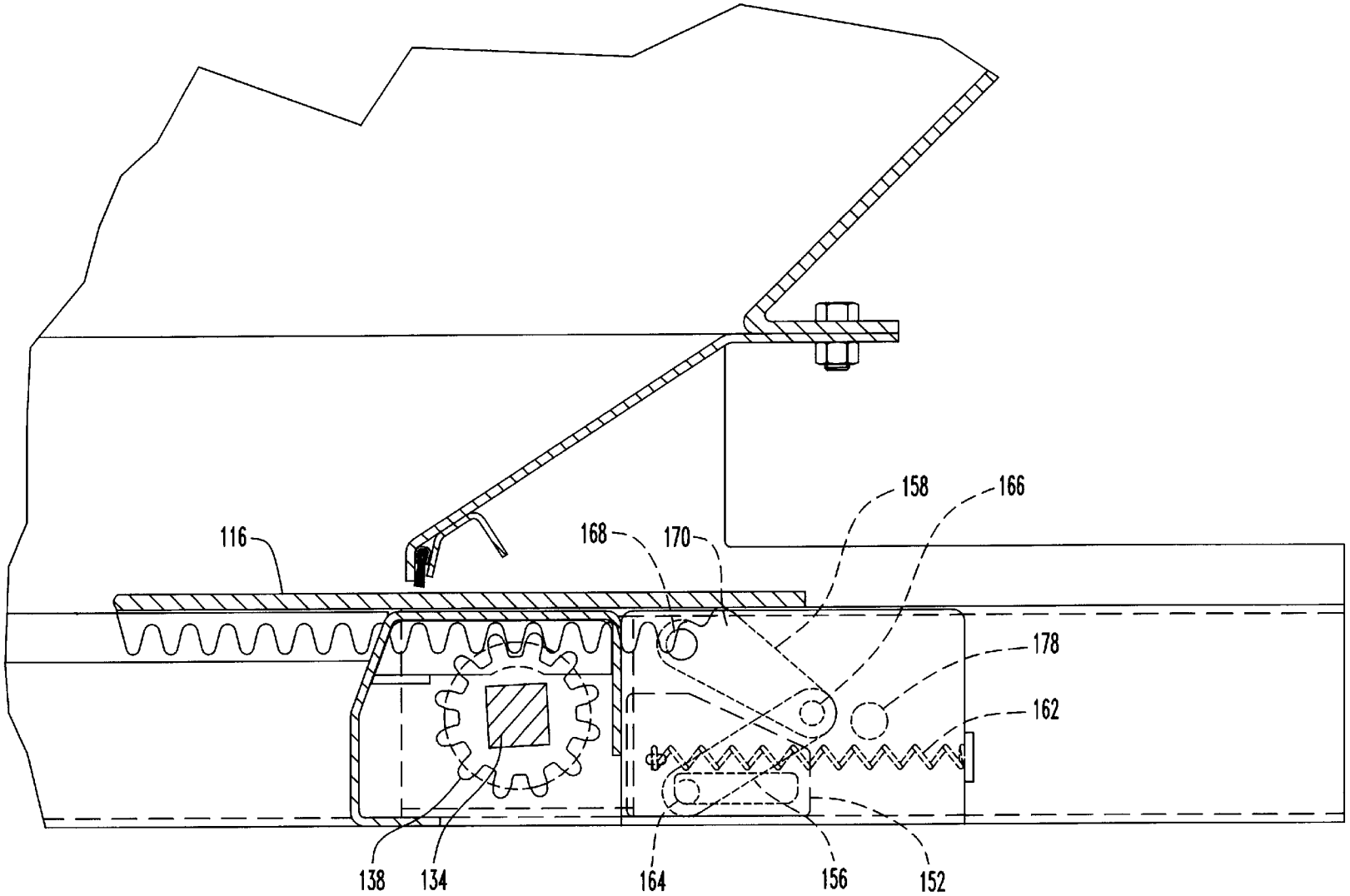
FIG. 18 is a sectional view similar to FIG. 15 but illustrating further opening of the outlet gate assembly.
Figure 19:
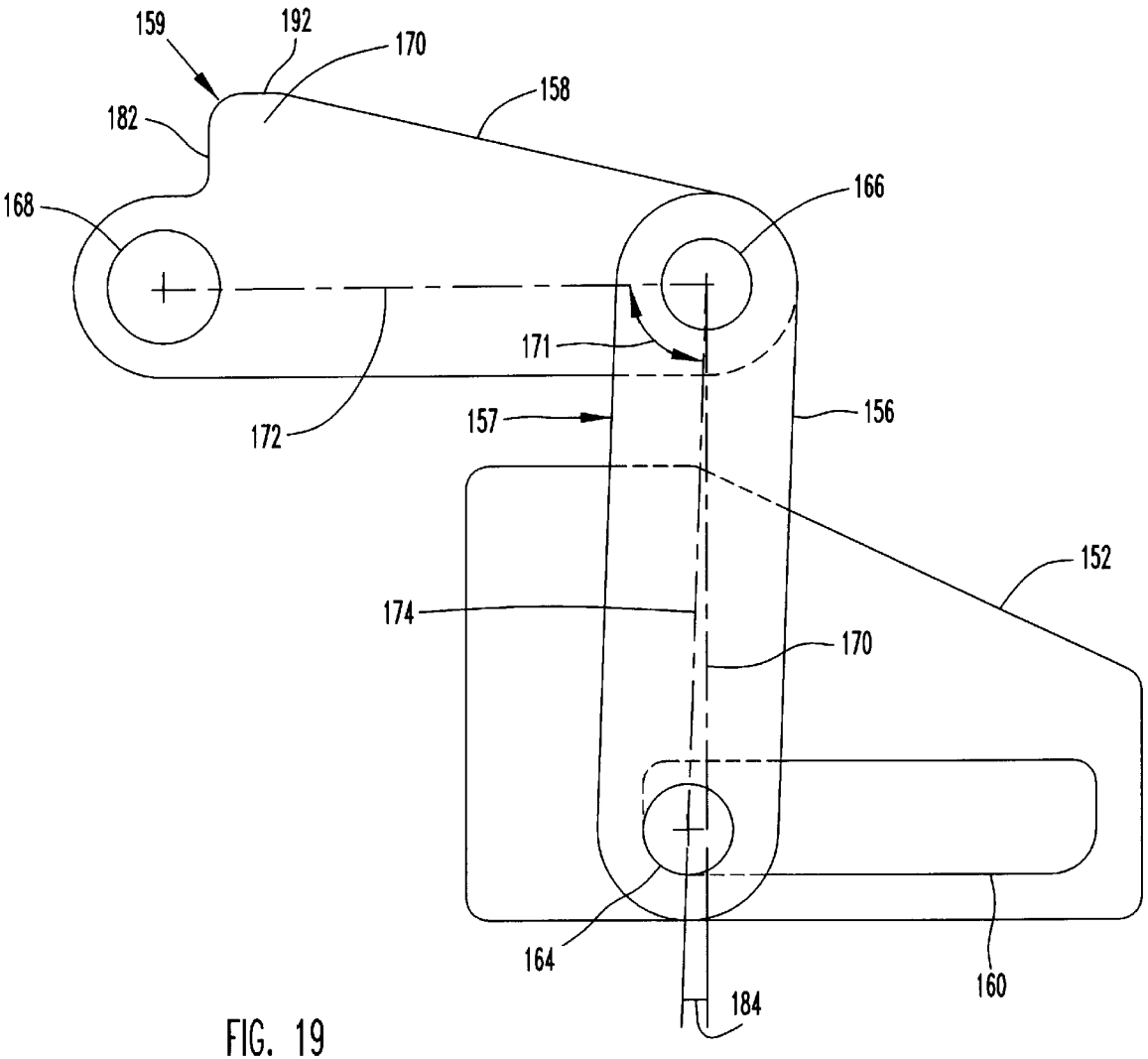
FIG. 19 is a diagrammatic view of the inertial latch of the outlet gate assembly shown in FIG. 12 in the latched position.

Mechanism 120 includes an inertial mass 152 resting freely on base 150 and connected to a two-bar linkage 154. The inertial mass 152 is free to slide along base 150 to the left or right as shown in FIGS. 15, 17 and 18, that is in the direction of opening movement of gate 116. Linkage 154 includes a like pair of spaced apart thrust links 156 forming a first bar or link 157 and a second bar or link 158. Latch 159 is provided on one end of bar 158. Horizontal slot 160 in inertial mass 152 extends in the opening and closing direction of the gate 116. Like coil springs 162 located on opposite sides of mass 152 extend from like fasteners 163 attached to either side of the inertial mass 152 to the front wall 148. Thrust pin 164 is fitted in slot 160 with ends of the thrust pin 164 extending beyond sides of the inertial mass 152. The lower ends of first bar 157 are pivotally mounted on the ends of the thrust pin 164. The upper ends of the bar 157 are joined to the front ends of the second bar 158 by pivot pin 166. The opposite or rear end of the second bar 158 is pivotally mounted on fixed support shaft 168 fastened between the side walls 146 of subframe 142. The latch 159 includes a nose or projection 170 that projects upwardly above shaft 168. The latch protrudes into the opening path of the gate 116 when the gate is closed to secure the gate 116 in the closed position. The second bar 158 extends horizontally from support shaft 168 to pivot pin 166 to define a horizontal axis 172. The first bar 157 extends nearly vertically from pin 166 to pin 164 to define a rear vertical axis 174 (See FIG. 19). Torsion spring 176 is mounted on the pivot pin 168 and engages the bar 158 to urge the bar 158 to rotate in a counterclockwise direction about the support shaft 168 as shown in FIG. 19. A pair of like stop members 178 extend from each sidewall 146 adjacent each of the thrust links 156.

The operation of the outlet gate assembly 110 in opening and closing the outlet gate assembly 110 will now be described.

When gate 116 is fully closed as shown in FIG. 15, the spring 176 applies a biasing force that generates a torque urging the second bar 158 to rotate counterclockwise about the support shaft 168 and press the latch 159 against the gate 116 to keep the gate 116 in the closed position.

The biasing force applied to the latch 159 by spring 176 is sufficient to maintain the latch 159 in the position shown in FIG. 15 to prevent accidental opening of the gate 116 due to vibrations of the railroad car during transit, train action loadings and other non-impact forces experienced during loading and transportation of the hopper railcar.

The outlet gate assembly 110 may be opened by a worker from either side of the rail car by rotating one of the capstans 140 in an opening direction. The worker may rotate the capstan 140 by using a power drive engaging the capstan 140 or a pry bar having an end inserted into a capstan to directly open the gate without lost motion.

The opening of closed and latched outlet gate assembly 110 by rotating the capstan 140 attached to the left end of the operating shaft 134 as shown in FIG. 15 in the opening direction will be described, it being understood that the outlet gate assembly 110 may also be opened in exactly the same manner by rotating the capstan 140 attached to the left end of the operating shaft 134 as shown in FIG. 12 in the opening direction.

Opening rotation of the operating shaft 134 rotates the pinion gears 138 meshed with racks 132 to begin moving the gate 116 outwardly in the direction of arrow 180 shown in FIG. 15. The gate 116 moving in the opening direction 180 applies a horizontal opening force at point 182. As gate 116 is moved from the closed position to the open position the gate 116 rotates the second bar and latch 159 from the latched position shown in FIG. 15 down around shaft 168 and out of the opening path of the gate 116 to an unlatched position shown in FIG. 18, thereby automatically unlatching the outlet gate assembly 110.

During unlatching, downward rotation of pin 166 forces the first bar 157 down against floor 150 and slides the lower end of the first bar rearwardly toward the front frame member 126 to rotate the first bar from the near vertical position of FIG. 5 through the position of FIG. 17 to the position of FIG. 18. The lower end of the first bar slides rearwardly because when the gate is latched closed axis 174 slopes rearwardly from vertical line 170 at an angle 184 of about 2 degrees, so that interior angle 171 between axises 172 and 174 is slightly less than 90 degrees and a component of the force exerted on the first bar by pin 166 slides the lower end of the bar rearwardly along the floor. Mass 152 moves rearwardly with pin 164. Springs 162 are elongated.

FIG. 18 illustrates the outlet gate assembly 110 with opening movement of the gate 116 sufficient to collapse the two-bar linkage 154 and unlatch the gate. As the gate 116 moves further in the opening direction 180, heel 192 contacts the bottom of the gate. Possible wear at heel 192 does not effect latching and unlatching. The inertial latch mechanism 120 remains in the unlatched position until the gate 116 has moved to the open position and is then reclosed.

The fully open outlet gate assembly 110 is fully closed and latched from the open position by rotating either of the capstans 50 in a closing direction. Closing rotation of the capstans 150 will rotate the operating shaft 134 and the pinions gears 138 to move gate 116 inwardly. As the gate 116 is moved to the fully closed position, the front edge of gate 116 will clear the latch 159 and the latch 159 will move into the latched position in the path of travel of the gate 116 to again latch the gate 116 closed. The springs 162 return the inertial mass 152 and the thrust pin 164 to the latched position. Stop members 178 are positioned to prevent possible overtravel of the inertial mass 152 in returning to the latched position and assure that the longitudinal axis 172 of the thrust links 156 does not reach a vertical orientation and the linkage does not collapse by increasing the interior angle.

Impacts expose the outlet gate assembly 110 of the railway car to accelerations tending to move the closed gate 116 in the opening direction in the same manner as previously described in connection with outlet gate assembly 110. The operation of the outlet gate assembly 110 during an impact tending to move the closed gate 116 in the opening direction will now be described.

The outlet gate assembly 110 is in the closed position as shown in FIG. 15 when an impact moves the closed gate 116 relative to the frame in the opening direction indicated by arrow 180 so that the gate 116 applies an opening force to the latch 159. If unopposed, this force will push the thrust pin 164 to the left or in a direction opposite the opening direction as the second bar 158 rotates down about support shaft 168. The inertial mass 152 senses the impact acting on the railway car. On impact, the inertial mass 152 accelerated relative to the frame in the opening direction of arrow 180. This inertial acceleration generates an inertial force in response to the impact. The inertial force acts in the opening direction and is greater than and resists the force applied by the first bar 157 biasing the inertial mass 152 to the left. The inertial mass 152 is sized such that sufficient inertial force is generated to overcome the force applied by the thrust pin 164 and maintain latch 159 in the latched position and gate 116 closed during the impact.

The opening force exerted by gate 116 on latch 59 generates a force on pin 164 proportional to the magnitude of the gate opening force multiplied by the sine of angle 184. Since the sine of a small angle is very small, the mass of body 152 may be considerably less than the mass of the gate to assure the latch holds the gate closed during impacts. The two-bar linkage has a force-multiplying geometry that allows the inertial force generated by mass 152 to be less than the opening force generated by the gate, yet assures that the inertial force overcomes the opening force and holds the gate closed.

Figure 9:
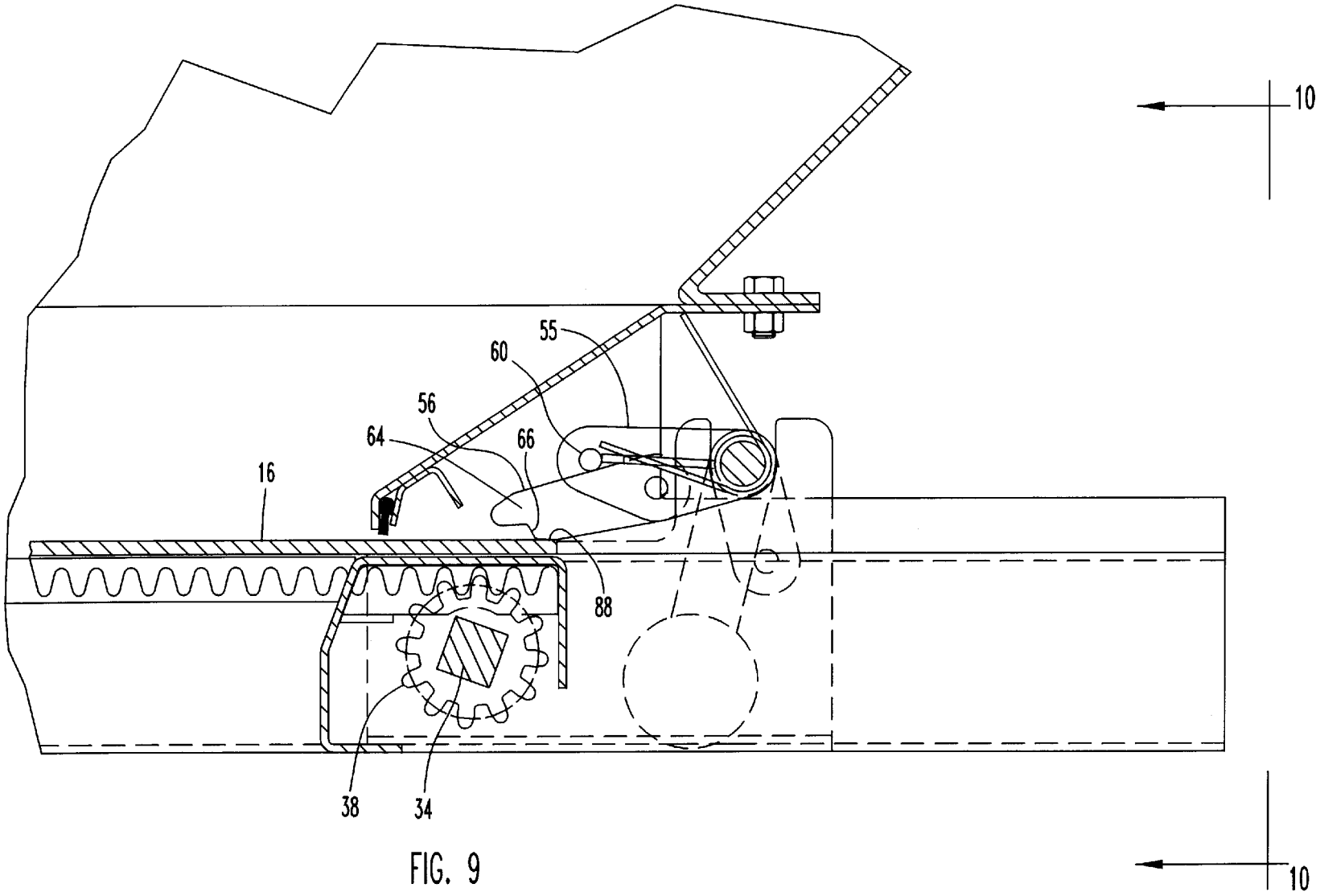
FIG. 9 is a sectional view similar to FIG. 7, but illustrating further opening of the outlet gate assembly.
Figure 10:
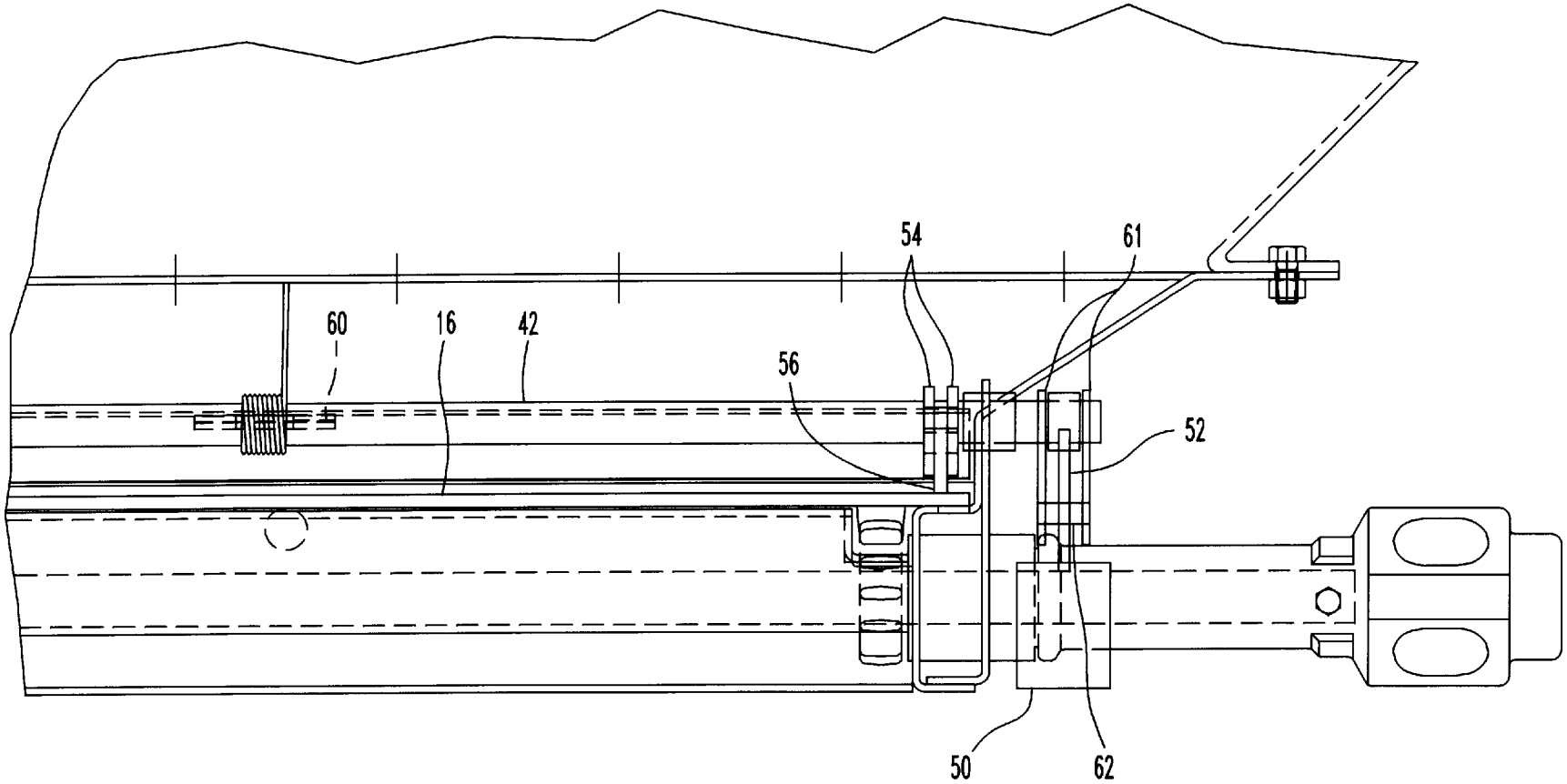
FIG. 10 is a partial front view of FIG. 9.

If the outlet gate assembly 110 is subjected to an impact tending to move the gate 116 in the closing direction (to the left as shown in FIG. 9) when the gate 116 is in the closed position, the rear frame member 122 will prevent movement of the gate 116. The impact will also attempt to accelerate the inertial mass 152 to the left with respect to the frame 12. The horizontal slot 160 forms a one way connection which permits the inertial mass 152 to slide to the left without moving the thrust pin 166 to the left. The springs 162 will extend and then return the inertial mass 152 back to the latched position.

Although both embodiments of the invention included a rack and pinion gate opening and closing drive 18, 118, it should be understood that alternative gate opening and closing drives can be used in alternative embodiments of the invention. The inertial latch mechanism operates independently of the gate opening and closing drive to permit other types of gate opening and closing drives to be used.

In both embodiments, an outlet gate assembly for controlling discharge of lading from a railcar or truck hopper includes a latch and an inertial mass which is connected to the latch such that during an impact tending to open the gate the same impact accelerates the inertial mass and generates a force which holds the latch closed to prevent opening of the gate. Both embodiments disclose a two-bar linkage connecting the latch to the gate where an impact in the opening direction exerts an impact force on the latch tending to collapse the linkage. An inertia force exerted on the linkage by an inertia mass resists collapse of the linkage which has a geometry that assures that the relatively small inertia force generated by the mass is sufficient to retain the latch in the locked position despite the larger opening force exerted on the latch by the relatively heavy gate. Other types of connections between an inertial mass and the latch in addition to the two-bar mechanical linkages may be used to join the inertial mass to the latch.

While we have illustrated and described preferred embodiments of the invention, it is understood that these embodiments are capable of modification, and we therefore do not wish to be limited to the precise details set forth, but desire to avail ourselves of such changes and alterations as fall within the purview of the following claims.

What we claim as our invention is:

1. An outlet gate assembly for a hopper-type railway car, said assembly comprising:

a frame defining a generally rectangular discharge opening;

a generally rectangular discharge gate mounted on said frame for opening and closing the discharge opening, said gate being movable on the frame between opened and closed positions along a predetermined path of travel;

a drive shaft mounted on said frame;

a rack on said gate;

a pinion gear mounted on said drive shaft, said pinion gear engaging said rack so that rotation of the drive shaft moves said gate between opened and closed positions; and an inertial latch mechanism including a latch movably mounted on said frame for movement between a latched position holding said gate in the closed position and an unlatched position, an inertial mass, a first connection movably securing the inertial mass to said frame and permitting movement of the inertial mass relative to the frame generally along the path; and a force-transmitting connection between said mass and said latch, whereby when the frame is impacted in a direction tending to open the gate the inertial mass generates an inertial force, the force-transmitting connection transmits the inertial force to the latch and the inertial force holds the latch in the latched position to prevent opening of the gate.

2. The outlet gate assembly as in claim 1 wherein said force-transmitting connection is mechanical.

3. The outlet gate assembly as in claim 2 wherein said force-transmitting connection includes a force multiplier.

4. The outlet gate assembly as in claim 3 wherein said force-transmitting connection includes a linkage.

5. The outlet gate assembly as in claim 4 wherein said latch is on a first link, and a link is joined to the frame.

6. The outlet gate assembly an in claim 5 wherein said links are pivoted together and define an interior angle of slightly less than either 90° or 180°.

7. The outlet gate assembly as in claim 6 wherein said linkage, includes a second link and said second link engages said first link between the pivot and the latch.

8. The outlet gate assembly as in claim 1 including a member biasing the latch toward the latched position.

9. The outlet gate assembly as in claim 8 wherein said member comprises a spring.

10. The outlet gate assembly as in claim 1 wherein said inertial mass biases the latch toward the latched position.

11. The outlet gate assembly of claim 1 wherein said inertial mass is slidably mounted on said frame.

12. The outlet gate assembly of claim 1 wherein said inertial mass is rotatably mounted on said frame.

13. The outlet gate assembly as in claim 12 wherein the mechanism includes an arm having a first end rotatably mounted to the frame for rotation about an axis and a second end joined to the mass.

14. The outlet gate assembly as in claim 13 wherein said mass is located below said first end of the arm.

15. The outlet gate assembly as in claim 14 wherein said axis is transverse to the opening direction of the gate.

16. The outlet gate assembly as in claim 1 including an arm having a first end rotatably mounted on the frame and a free end, said inertial mass on said free end of the arm; said mechanism including a linkage having a first link rotatably joined to the frame and fixedly joined to the first end of the arm, and a second link pivotally joined to the first link, said latch on said second link, said links defining an interior angle less than 180°, and a stop member on one link engaging the other link.

17. The outlet gate assembly as in claim 16 including a spring urging the latch toward the latched position.

18. The outlet gate assembly as in claim 1 wherein the inertial latch mechanism includes a first link pivotally mounted on the frame, a second link pivotally joined to the first link, said latch located on one of said links.

19. The outlet gate assembly as in claim 1 wherein said links define an interior angle of slightly less than either 90° or 180°.

20. The outlet gate assembly as in claim 1 wherein the inertial mass is rotatably mounted on the frame.

21. The outlet gate assembly as in claim 1 wherein the inertial mass is slidably mounted on the frame.

22. The outlet gate assembly as in claim 1 wherein said inertial latch mechanism includes an inertial force multiplier.

23. The outlet gate assembly as in claim 1 including a spring biasing the latch towards the latched position.

24. The outlet gate assembly of claim 1 including a one-way connection between the inertial mass and the latch.

25. The outlet gate assembly for controlling discharge of lading from a hopper, said assembly comprising:

a frame defining a discharge opening;

a discharge gate mounted on said frame for opening and closing the discharge opening, said gate being movable between closed and opened positions;

a gate opening and closing drive directly engaging said gate for moving said gate between the open and closed positions; and an inertial latch mechanism on the frame, said mechanism including a latch mounted on said frame for latching said gate in the closed position, said latch movable between a latched position and an unlatched position, an inertial mass a first connection movably mounting the inertial mass on the frame for movement generally parallel to movement the gate on the frame, and a force-transmitting connection between the inertial mass and the latch, whereby when an impact is applied to the frame in a direction tending to open the gate the inertial mass generates an inertial force, the inertial force is transmitted to the latch through the force-transmitting connection and the inertial force holds the latch in the closed position to prevent opening of the gate.

26. The outlet gate assembly of claim 25 wherein:

said latch includes a surface located in the path of travel of said gate to engage said gate and maintain said gate in the closed position; and said inertial latch mechanism includes a one-way connection permitting movement of said latch surface from the latched position to the unlatched position when said gate is moved from the closed position towards the open position by said gate opening and closing drive.

27. The outlet gate assembly of claim 26 wherein said latch is pivotally mounted to said frame.

28. The outlet gate assembly of claim 25 further including:

a linkage pivotally connected to the frame, said latch on one link of said linkage.

29. The outlet gate assembly as in claim 28 including a first pivot connection between the first and second links, a second pivot connection between a link and the frame, said latch on one of said links, and said first and second links defining an interior angle at said pivot connection of slightly less than either 90° or 180°.

30. The outlet gate assembly as in claim 25 wherein said inertial gate mechanism includes an inertia force multiplier.

31. The outlet gate assembly of claim 25 further including:

a support shaft rotatably mounted on said frame;

said inertial latch mechanism including a pair of pivoted bars, one end of one bar being nonrotatably mounted to said support shaft for pivoting movement with said shaft, said latch on the other bar;

said bars located between said gate and said support shaft when said gate is in the closed position and defining an interior angle.

32. The outlet gate assembly as in claim 31 wherein said interior angle is slightly less than either 90° or 180°.

33. The outlet gate assembly according to claim 32, including a stop member for limiting increase of the interior angle.

34. The outlet gate assembly according to claim 31, including a biasing member urging said latch toward the latched position.

35. The outlet gate assembly as in claim 31 wherein said inertial mass is rotatably mounted on the frame.

36. The outlet gate assembly as in claim 31 wherein said connection includes a one-way coupling.

37. The outlet gate assembly as in claim 36 wherein said coupling is rotary.

38. The outlet gate assembly as in claim 36 wherein said coupling is linear.

39. The outlet gate assembly of claim 31 wherein the weight of said inertial mass is less than the weight of said gate.

40. A method of operating an outlet gate assembly for a hopper-type railway car of the type having a frame defining a discharge opening, a discharge gate mounted on the frame for opening and closing the discharge opening, the gate being movable between open and closed positions along a predetermined path of travel, a gate opening and closing drive directly coupled to the gate for moving the gate between the open and closed positions along the predetermined path of travel, a latch movable between a latch position in the opening path of the gate for latching the gate closed and an unlatched position out of the opening path of the gate, an inertial mass movably mounted to the frame for movement in the direction the gate moves on the frame, and a force-transmitting connection between the inertial mass and the latch, including the simultaneous steps of:

a) applying an impact to the frame tending to move the gate in an opening direction in the frame and against the closed latch; and b) applying the same impact to the inertial mass to generate an inertial force and communicating the inertial force through the connection to the latch to hold the latch closed and prevent the impact from opening the gate.

41. The method of claim 40 including the step of:

c) multiplying the second force before applying the second force to the latch.

42. The method of claim 40 including the steps of:

c) actuating the drive to move the gate from the closed position toward the open position for opening the gate; and d) moving the plate against the latch and pushing the latch from the latched position to the unlatched position.

43. An outlet gate assembly for controlling discharge of lading from a hopper, said assembly comprising:

a frame defining a discharge opening;

a discharge gate mounted on the frame for opening and closing the discharge opening, said gate being moveable between closed and open positions;

a gate opening and closing drive engaging the gate for moving the gate between open and closed positions;

a latch mounted on the frame for latching said gate in the closed position; and means for exerting an inertial force generated by an impact against the latch to hold the gate closed during the impact.

44. An outlet gate assembly as in claim 43 wherein said means comprises a mass movably mounted on the frame.

45. An outlet gate assembly as in claim 44 including an inertial force multiplier located between the mass and the latch.

* * * * *